US011708129B2

(12) United States Patent
Oswell et al.

(10) Patent No.: US 11,708,129 B2
(45) Date of Patent: Jul. 25, 2023

(54) TELESCOPING TOWER FOR A BOAT

(71) Applicant: ROSWELL CANADA INC., Acheson (CA)

(72) Inventors: Robert Oswell, Merritt Island, FL (US); Darrick Wilson, Edmonton (CA); Stephen D. Aboud, Cocoa Beach, FL (US)

(73) Assignee: ROSWELL CANADA INC., Acheson (CA)

( * ) Notice: Subject to any disclaimer, the term of this patent is extended or adjusted under 35 U.S.C. 154(b) by 137 days.

(21) Appl. No.: 17/360,332

(22) Filed: Jun. 28, 2021

(65) Prior Publication Data

US 2021/0394868 A1 Dec. 23, 2021

Related U.S. Application Data

(63) Continuation-in-part of application No. 16/540,770, filed on Aug. 14, 2019, now Pat. No. 11,046,397.

(60) Provisional application No. 62/718,528, filed on Aug. 14, 2018.

(51) Int. Cl.
*B63B 17/00* (2006.01)
*B63B 29/04* (2006.01)

(52) U.S. Cl.
CPC ..... *B63B 17/00* (2013.01); *B63B 29/04* (2013.01); *B63B 2029/043* (2013.01)

(58) Field of Classification Search
CPC ... B63B 35/815; B63B 2241/20; B63B 34/00; B63B 34/60; B63B 34/67; B63B 29/04; B63B 2029/04; B63B 15/00; B63B 17/00; B63B 2017/02
USPC ..... 114/253, 343, 354, 361, 364
See application file for complete search history.

(56) References Cited

U.S. PATENT DOCUMENTS

| | | | | |
|---|---|---|---|---|
| 3,724,595 | A | 4/1973 | Green | |
| 5,918,613 | A | 7/1999 | Larson | |
| 6,349,666 | B1 | 2/2002 | Hastings | |
| 6,584,926 | B1 | 7/2003 | Schmitt et al. | |
| 6,666,163 | B2 | 12/2003 | Pastor | |
| 6,860,222 | B2 | 3/2005 | Himmel | |
| 6,988,461 | B1 | 1/2006 | James | |
| 8,205,571 | B1 * | 6/2012 | Rondeau | B63B 17/02 114/361 |
| 8,281,732 | B1 | 10/2012 | Irvine | |
| 11,046,397 | B2 | 6/2021 | Oswell et al. | |
| 2020/0055576 | A1 | 2/2020 | Oswell et al. | |

* cited by examiner

*Primary Examiner* — Daniel V Venne
(74) *Attorney, Agent, or Firm* — Timothy H. Van Dyke; Wolter, Van Dyke, Davis, PLLC

(57) ABSTRACT

A telescoping boat tower (1800), including: a center section (1814); a first support (1802) secured to a first end of the center section, the first support including a first telescoping assembly (1804); and a second support (1808) secured to a second end of the center section, the second support including a second telescoping assembly (1810). The first telescoping assembly and the second telescoping assembly cooperate to raise and lower the center section between a first position and a second position. The center section includes an integrated sun lounge platform (1820) configured as a cockpit cover for a boat, the sun lounge platform including a seating arrangement (1822).

21 Claims, 21 Drawing Sheets

Male and Female Slide System (1500)

TELESCOPING TOWER FOR A BOAT

CROSS-REFERENCE TO RELATED APPLICATION

This continuation in part application claims the benefit of U.S. provisional patent application Ser. No. 62/718,528, entitled "Telescoping Tower for a Boat," filed on Aug. 14, 2018, the entire disclosure of which is incorporated herein by reference. This continuation in part application claims the benefit of U.S. Pat. No. 11,046,397 entitled "Telescoping Tower for a Boat," filed on Aug. 14, 2019, the entire disclosure of which is incorporated herein by reference.

FIELD OF THE INVENTION

The present invention generally relates to a tower or arch like structure that may be mounted to a boat. More particularly, the tower may be used for towing an individual participating in watersports, aiding in equipment storage, aiding in a Bimini system, supporting a platform for sun lounging, seating, and distance viewing, and mounting various types of equipment.

BACKGROUND OF THE INVENTION

Boat towers are used for a number of purposes where elevation above the boat deck is useful. In watersports, a tower can be used to anchor the towline at a high elevation above the boat deck, thereby increasing the performer's ability to be lifted higher into the air, whether with a ski or wakeboard. The towing structure has evolved to be integrated into Bimini systems for purposes of protection from the sun and weather, and to provide a mounting structure for various types of equipment whose function may be improved from elevation, such as navigational and communications equipment, speakers, fishing rods, and lighting. Towers can also be used to provide additional space to the boat for purposes of equipment storage and additional seating, and to increase distance viewing capabilities for purposes of navigation and fishing.

BRIEF SUMMARY OF DISCLOSURE

In an example embodiment, the apparatus comprises: a center section; a first support secured to a first end of the center section, the first support comprising a first telescoping assembly; and a second support secured to a second end of the center section, the second support comprising a second telescoping assembly; wherein the first telescoping assembly and the second telescoping assembly cooperate to raise and lower the center section between a first position and a second position; and wherein the center section comprises an integrated sun lounge platform configured as a cockpit cover for a boat, the sun lounge platform comprising a seating arrangement.

In an example embodiment, the apparatus comprises: a center section configured as a cockpit cover for a boat; a first support secured to a first end of the center section, the first support comprising a first telescoping assembly; and a second support secured to a second end of the center section, the second support comprising a second telescoping assembly; wherein the first telescoping assembly and the second telescoping assembly cooperate to raise and lower the center section between a first position and a second position; and wherein at least one of the first support and the second support comprises a storage compartment.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
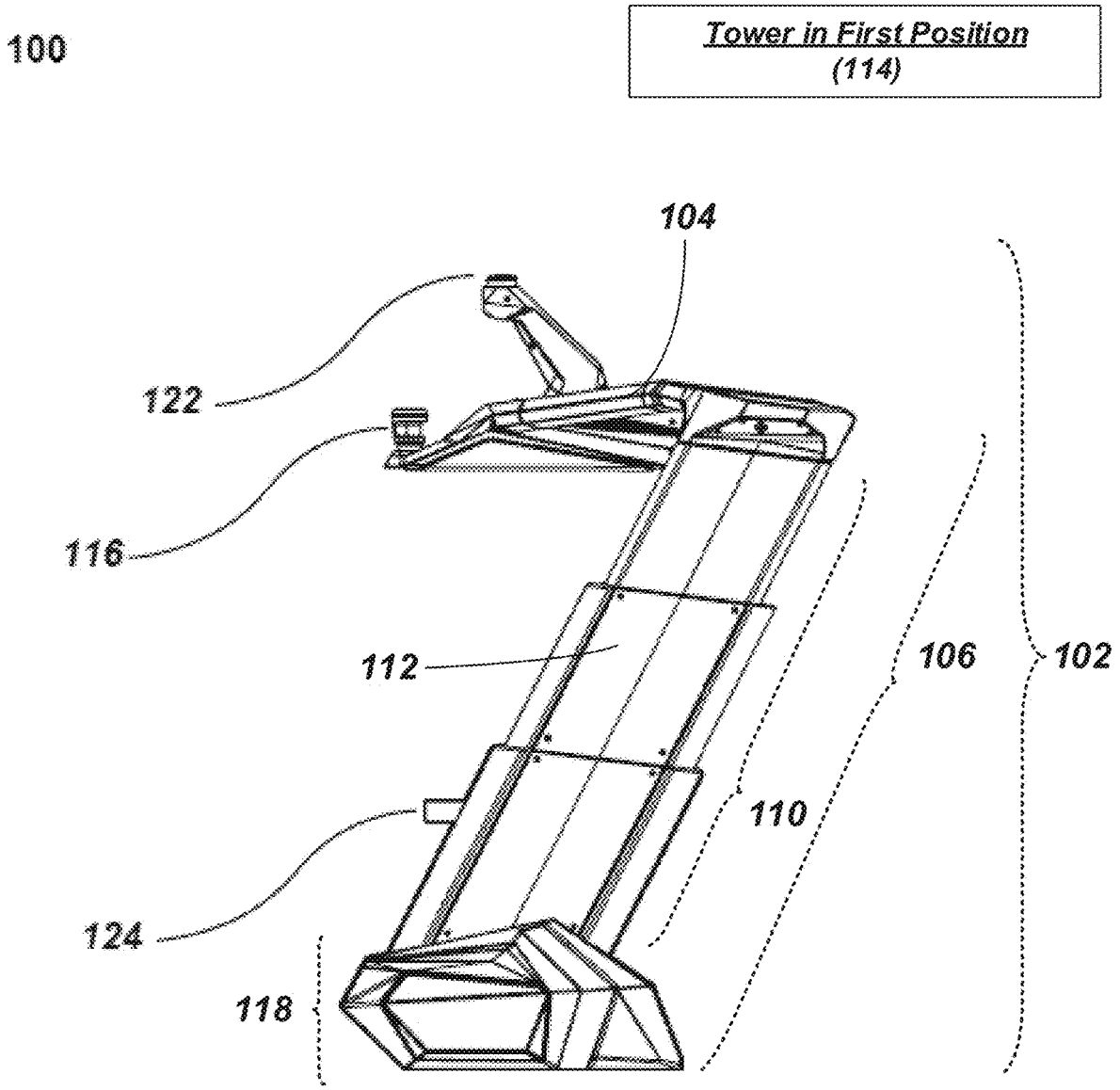
FIG. 1 is a side view of an illustrative example embodiment of a telescoping tower system in a first position.
Figure 2:
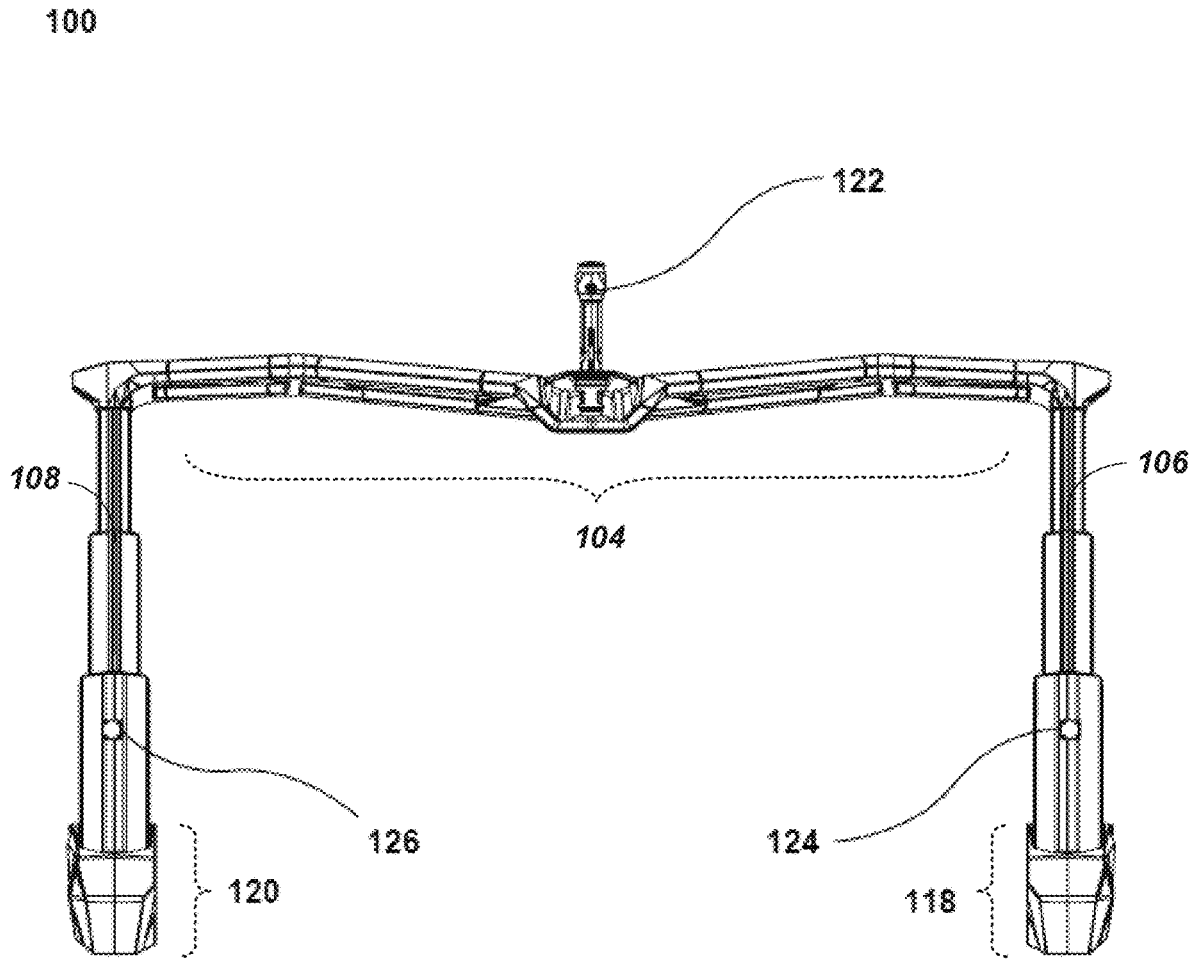
FIG. 2 is a rear view of the illustrative example embodiment of the telescoping tower system of FIG. 1 in the first position.
Figure 3:
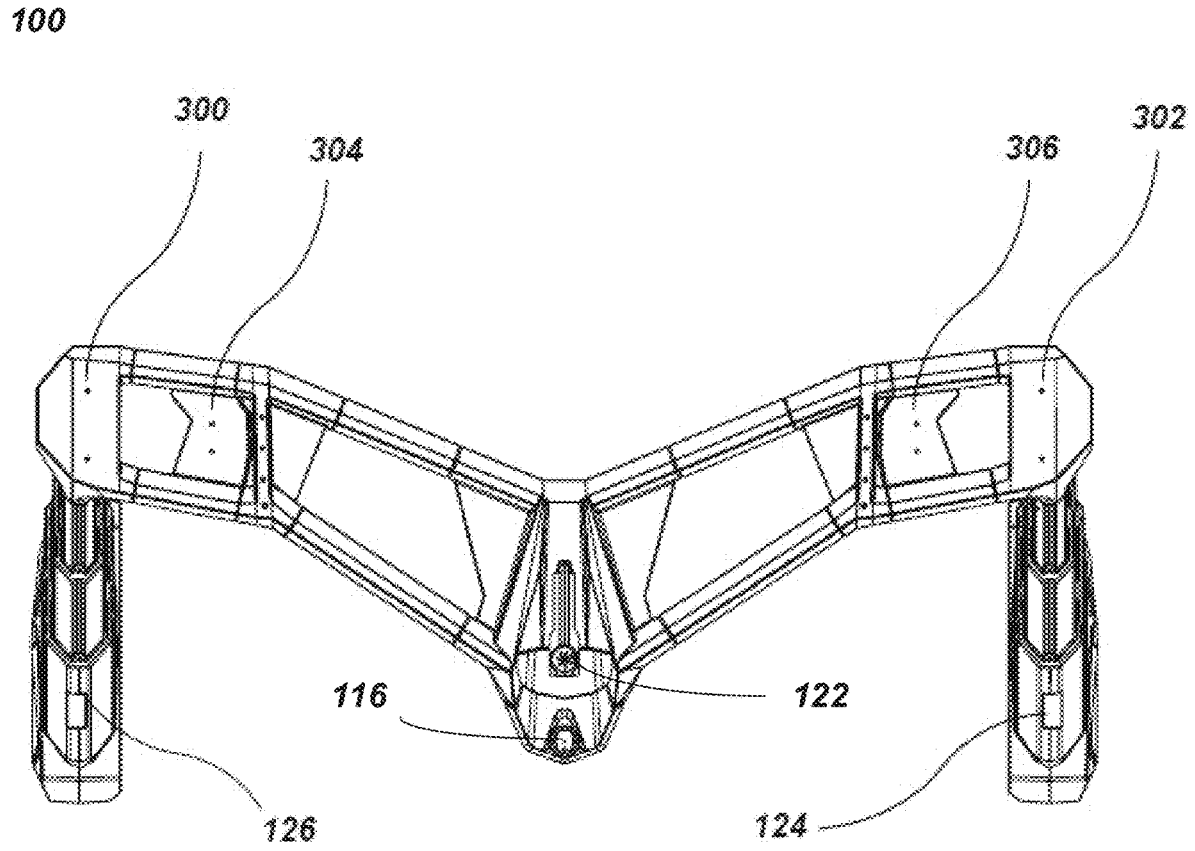
FIG. 3 is a top view of the illustrative example embodiment of the telescoping tower system of FIG. 1 in the first position.
Figure 4:
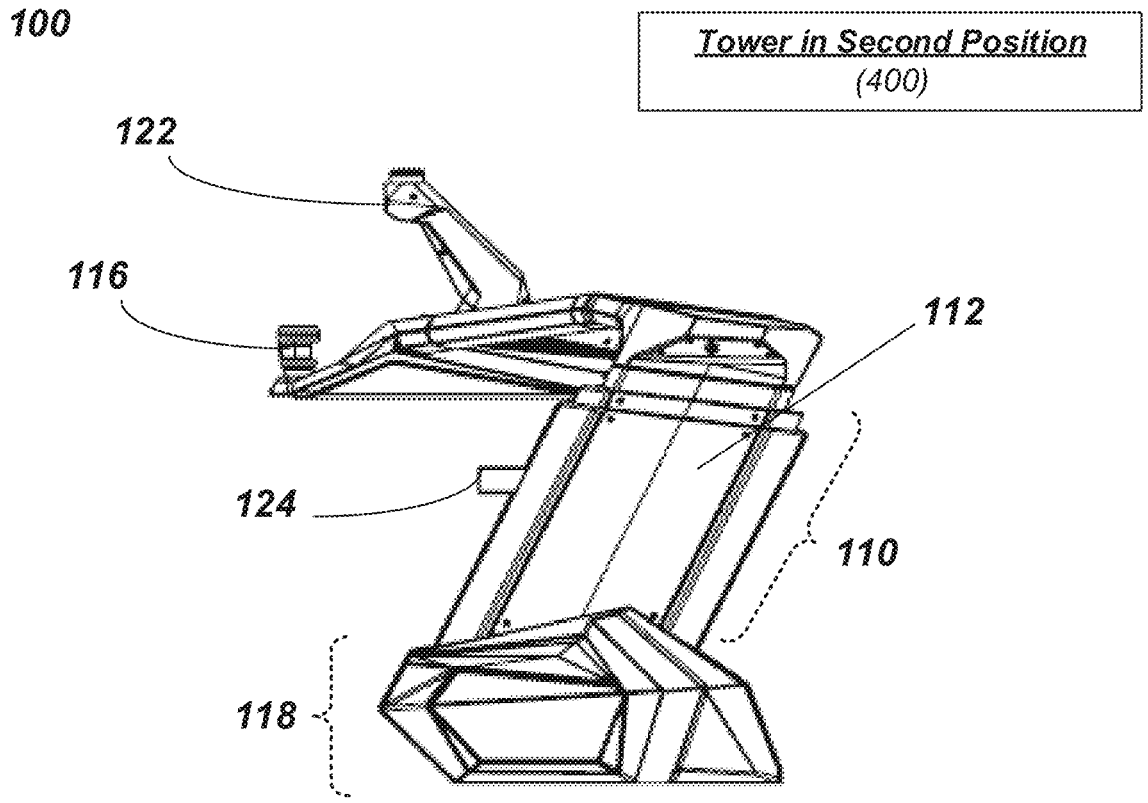
FIG. 4 is a side view of an illustrative example embodiment of a telescoping tower system of FIG. 1 in a second position.
Figure 5:
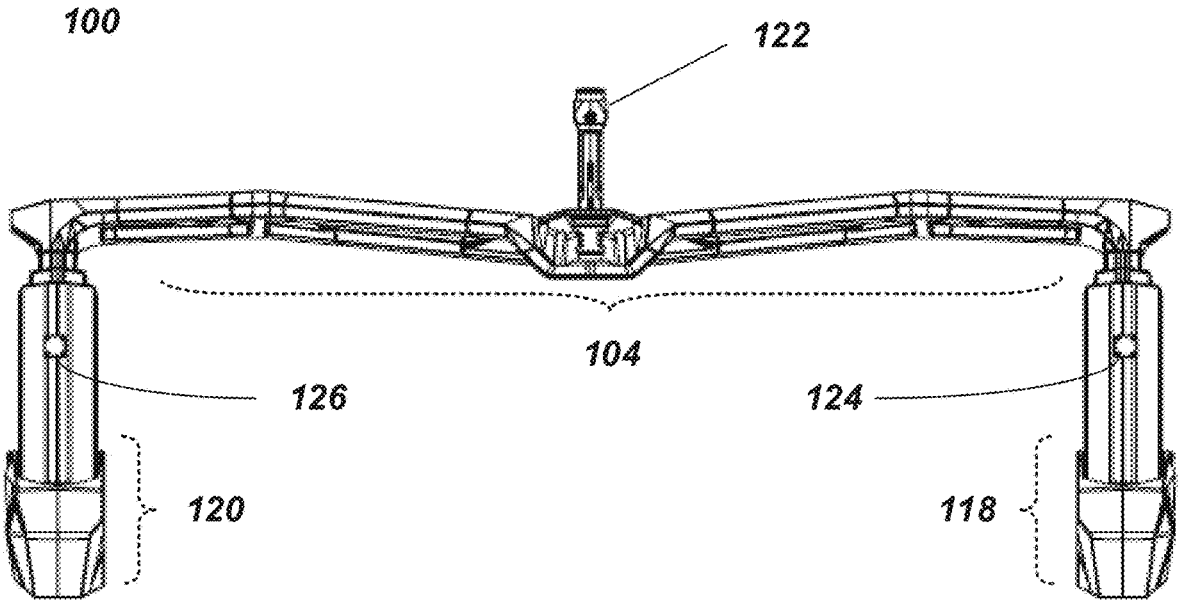
FIG. 5 is a rear view of the illustrative example embodiment of the telescoping tower system of FIG. 1 in the second position
Figure 6:
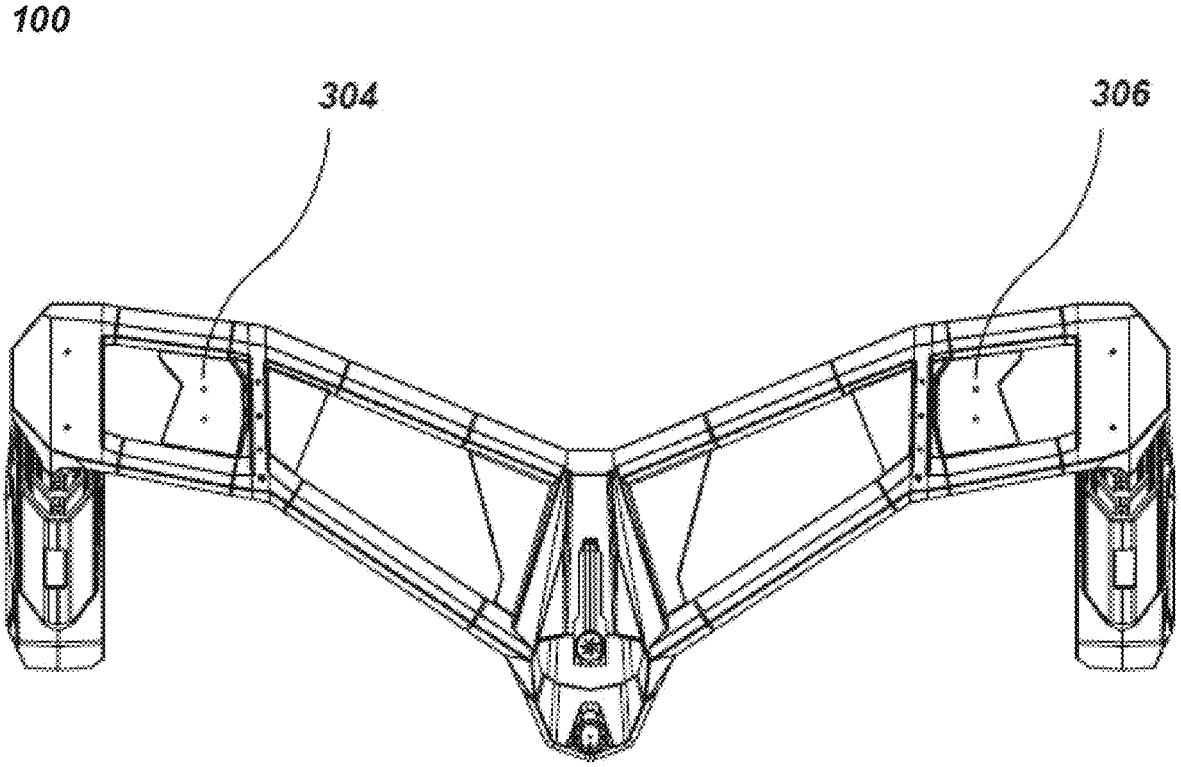
FIG. 6 is a top view of the illustrative example embodiment of the telescoping tower system of FIG. 1 in the second position.
Figure 7:
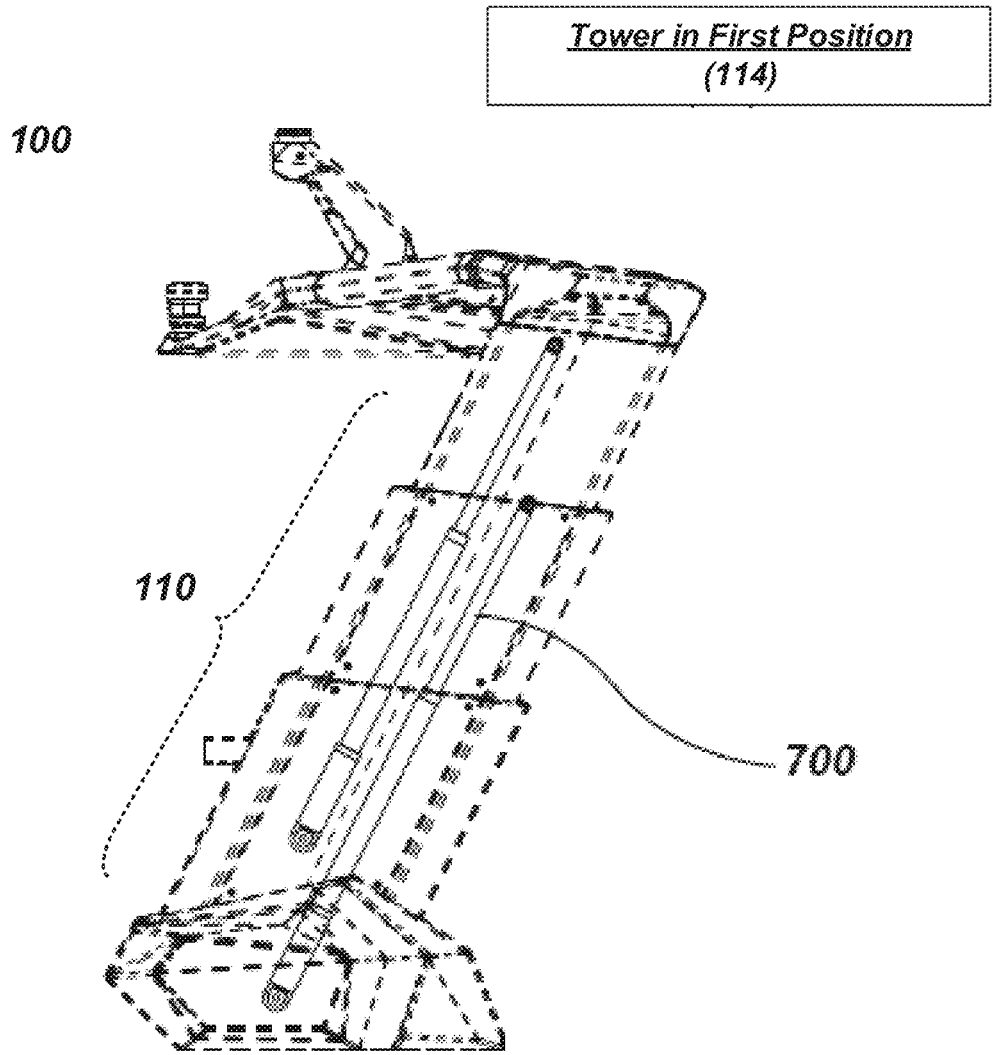
FIG. 7 is a perspective view of the illustrative example embodiment of the telescoping tower system of FIG. 1 in a first position with the covers of the supports removed and/or transparent.
Figure 8:
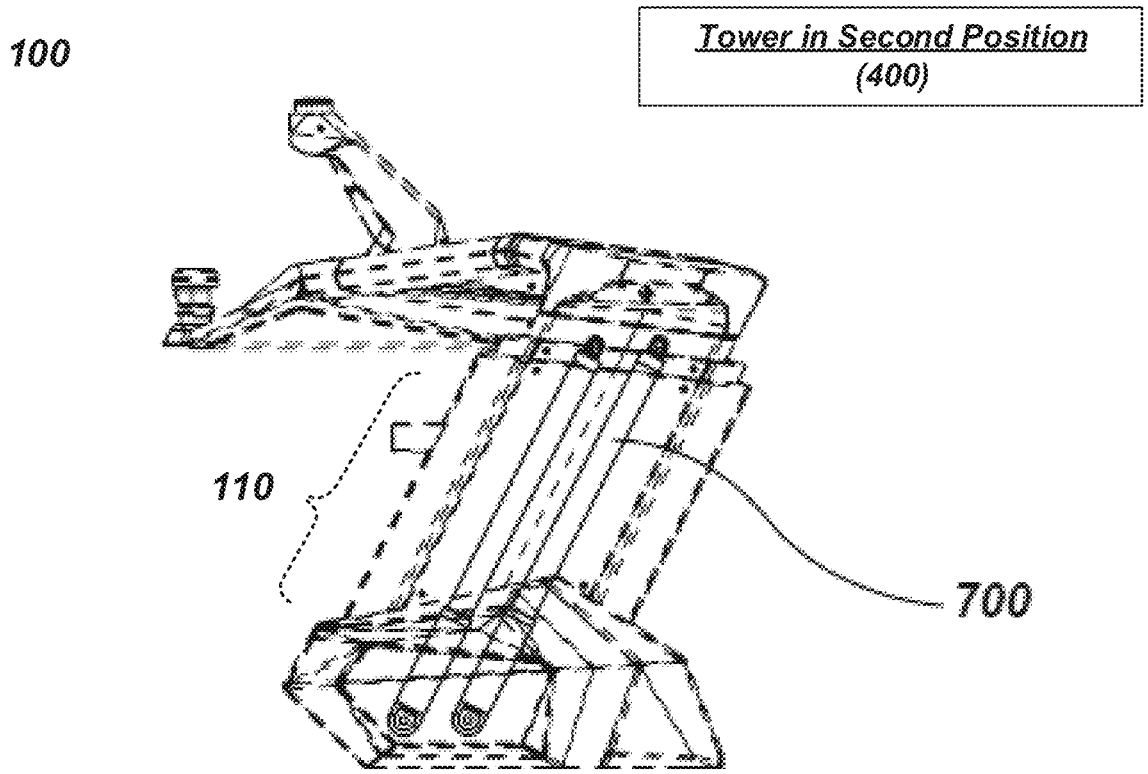
FIG. 8 is a perspective view of the illustrative example embodiment of the telescoping tower system of FIG. 1 in a second position with the covers of the supports removed and/or transparent.
Figure 9:
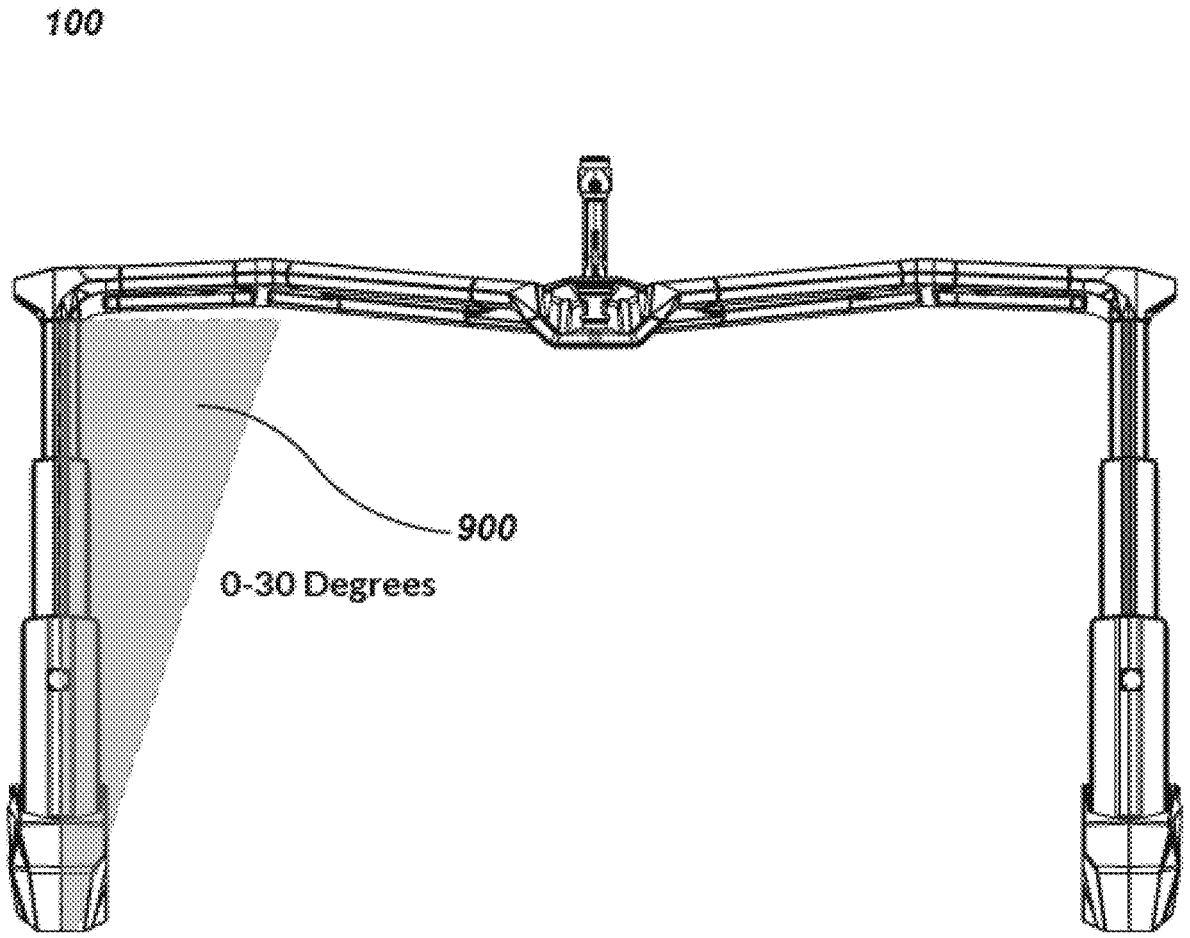
FIG. 9 is a rear view of an illustrative example of the telescoping tower that diagrammatically depicts the degree at which the supports of the telescoping tower are angled relative to the illustrative example embodiment of FIG. 1.
Figure 10:
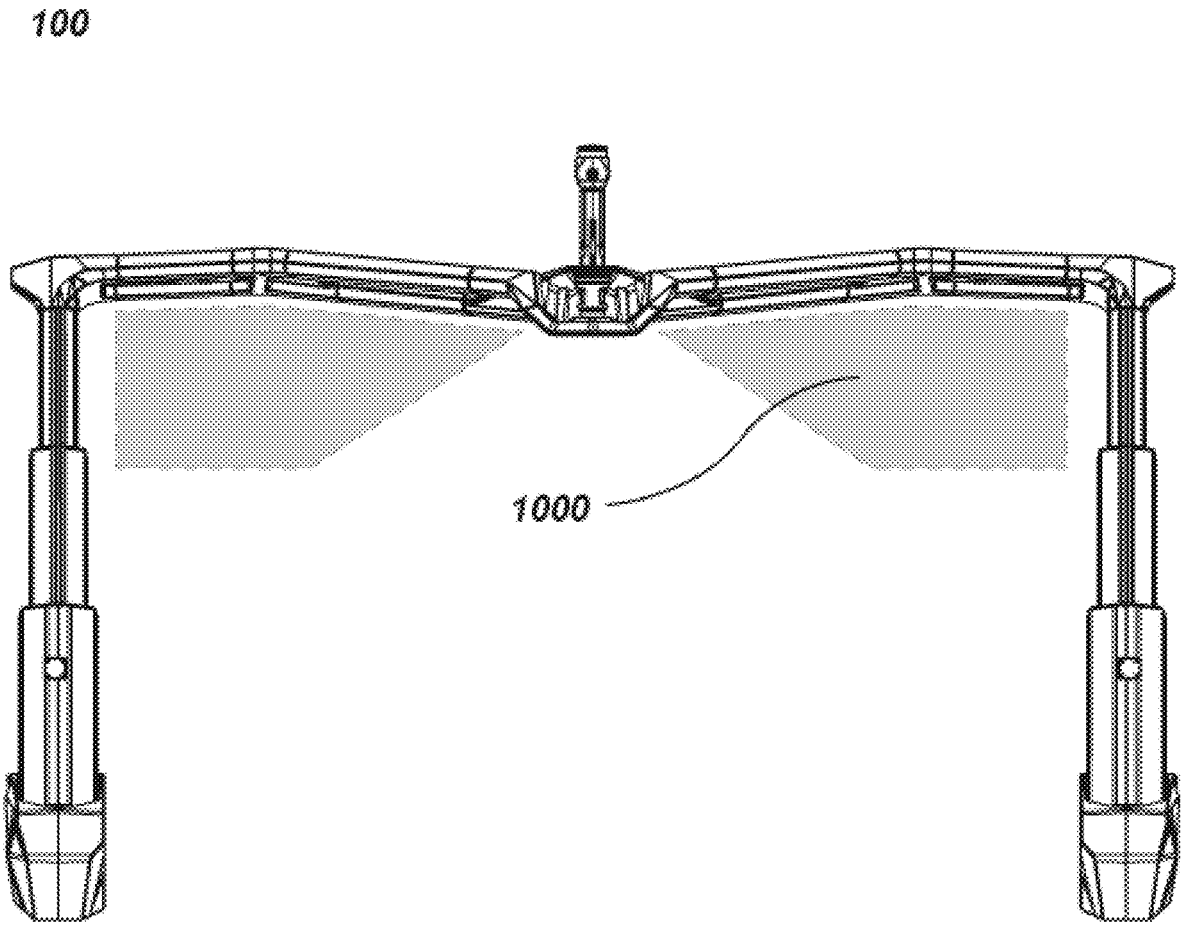
FIG. 10 diagrammatically depicts a designated area where integrated speakers or other equipment may be mounted near to a central section of the telescoping tower relative to the illustrative example embodiment of FIG. 1.
Figure 12:
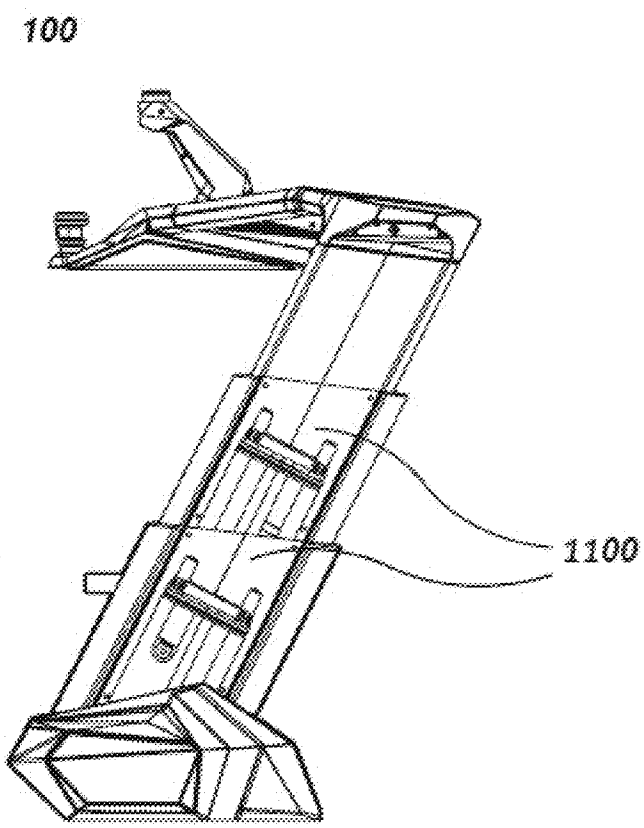
FIG. 12 is a side view of the illustrative example embodiment of FIG. 11 in the first position with the access plates to the interior portion of the supports removed and/or transparent.
Figure 11:
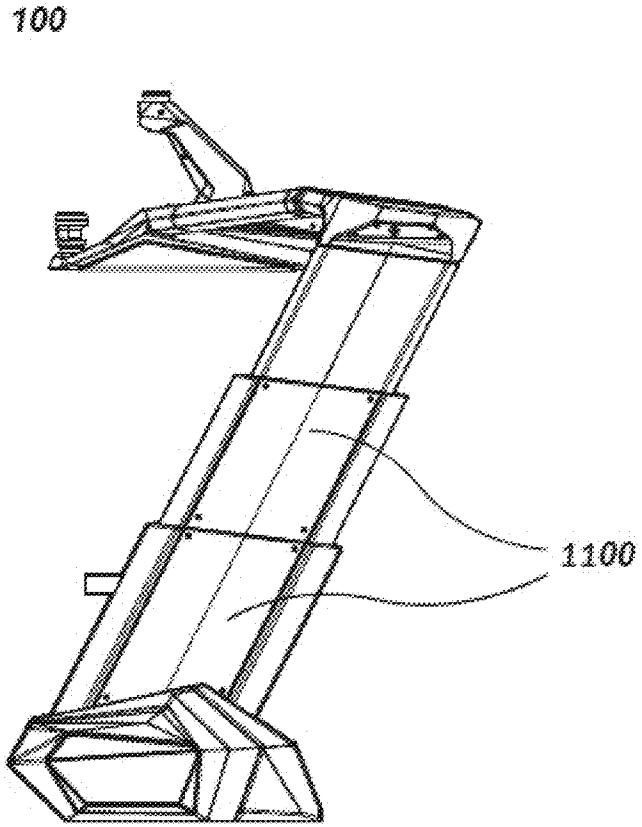
FIG. 11 is a side view of the illustrative example embodiment of the telescoping tower of FIG. 1 in the first position with access plates to the interior portion of the side supports attached.
Figure 13:
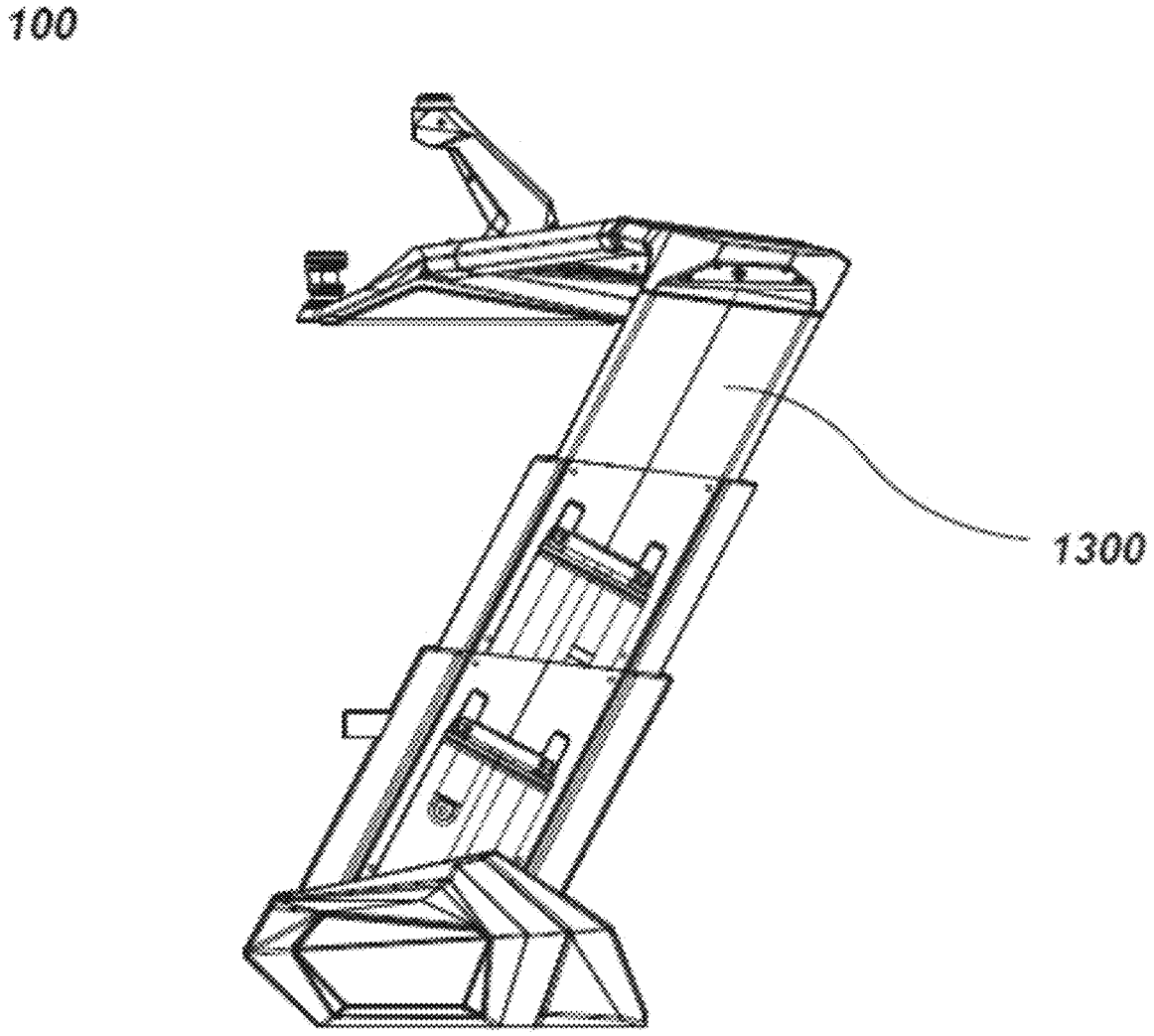
FIG. 13 is a side view of the illustrative example embodiment of FIG. 11 in the first position diagrammatically depicting a horizontal wedge shape of the removed and/or transparent access plates to the interior portion of the supports.
Figure 16:
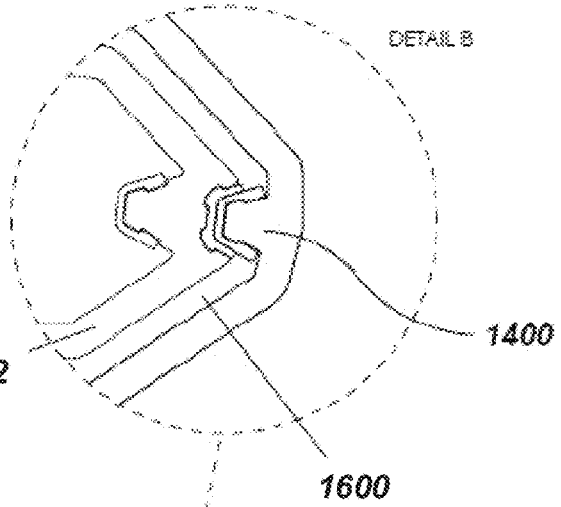
FIG. 16 diagrammatically depicts a magnified view of the cross-section of the male and female slide system of the illustrative example embodiment of FIG. 15.
Figure 15:
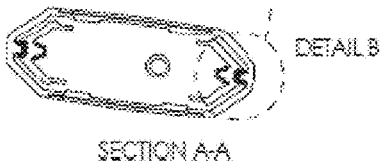
FIG. 15 diagrammatically depicts a cross-section view of the male and female slide system of the illustrative example embodiment of FIG. 14.
Figure 14:
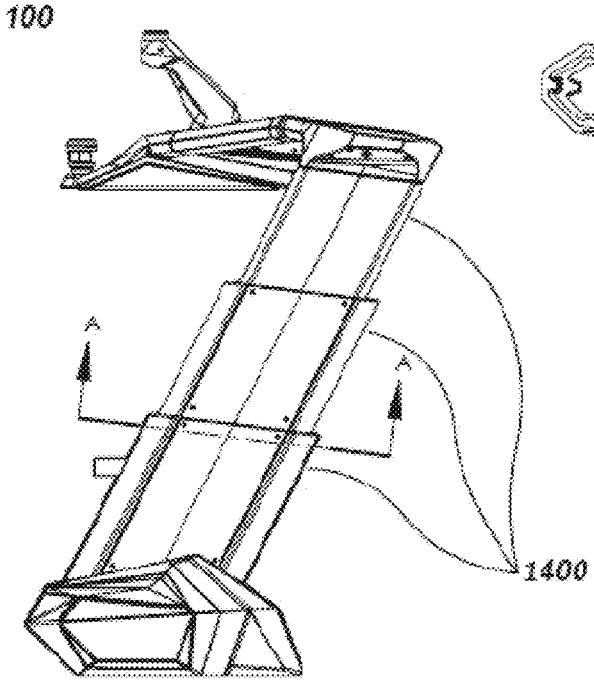
FIG. 14 diagrammatically depicts a side view of a male and female slide system of the illustrative example embodiment of the telescoping tower of FIG. 1.
Figure 17:
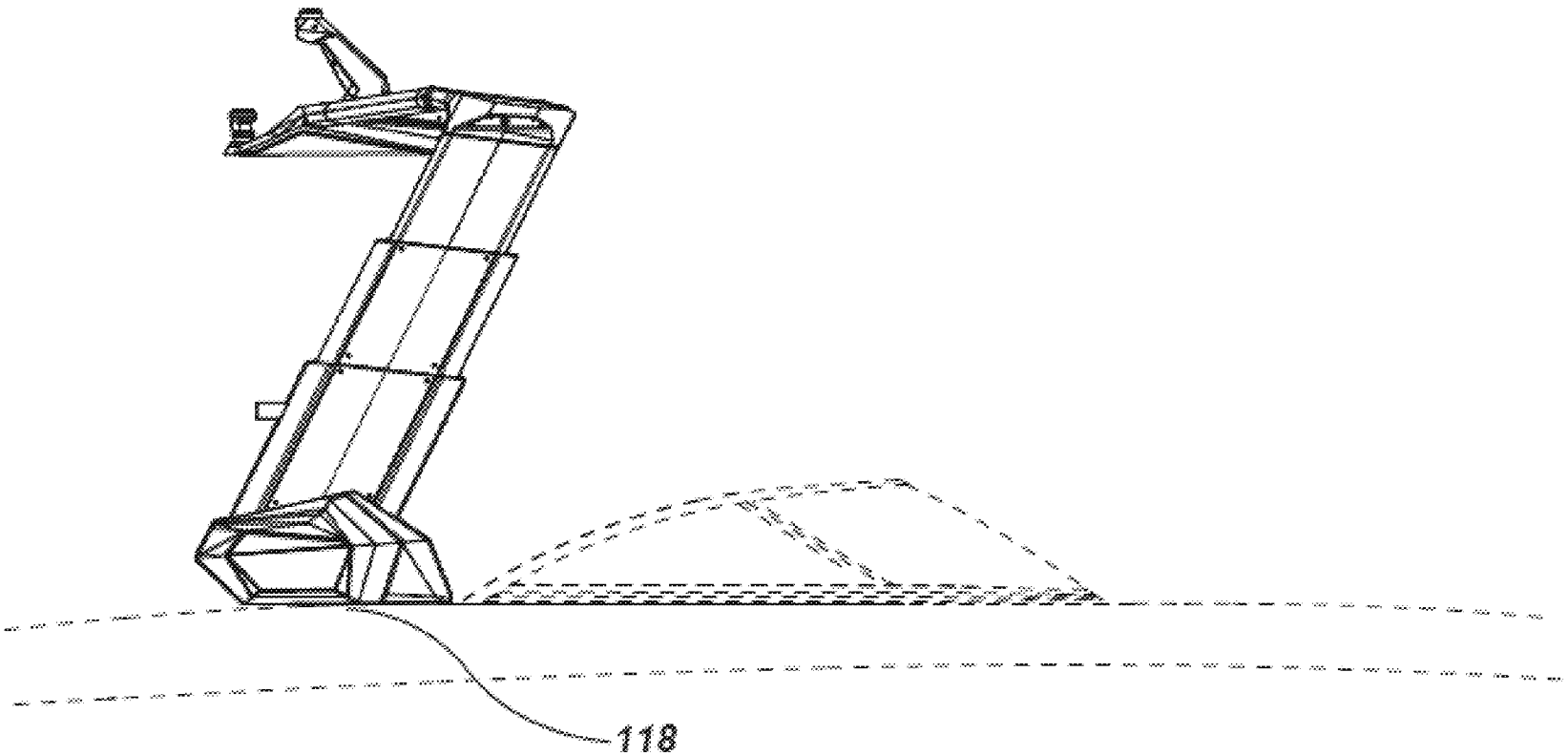
FIG. 17 diagrammatically depicts the illustrative example embodiment of the telescoping tower of FIG. 1 attached to a boat by one or more respective bases.
Figure 18:
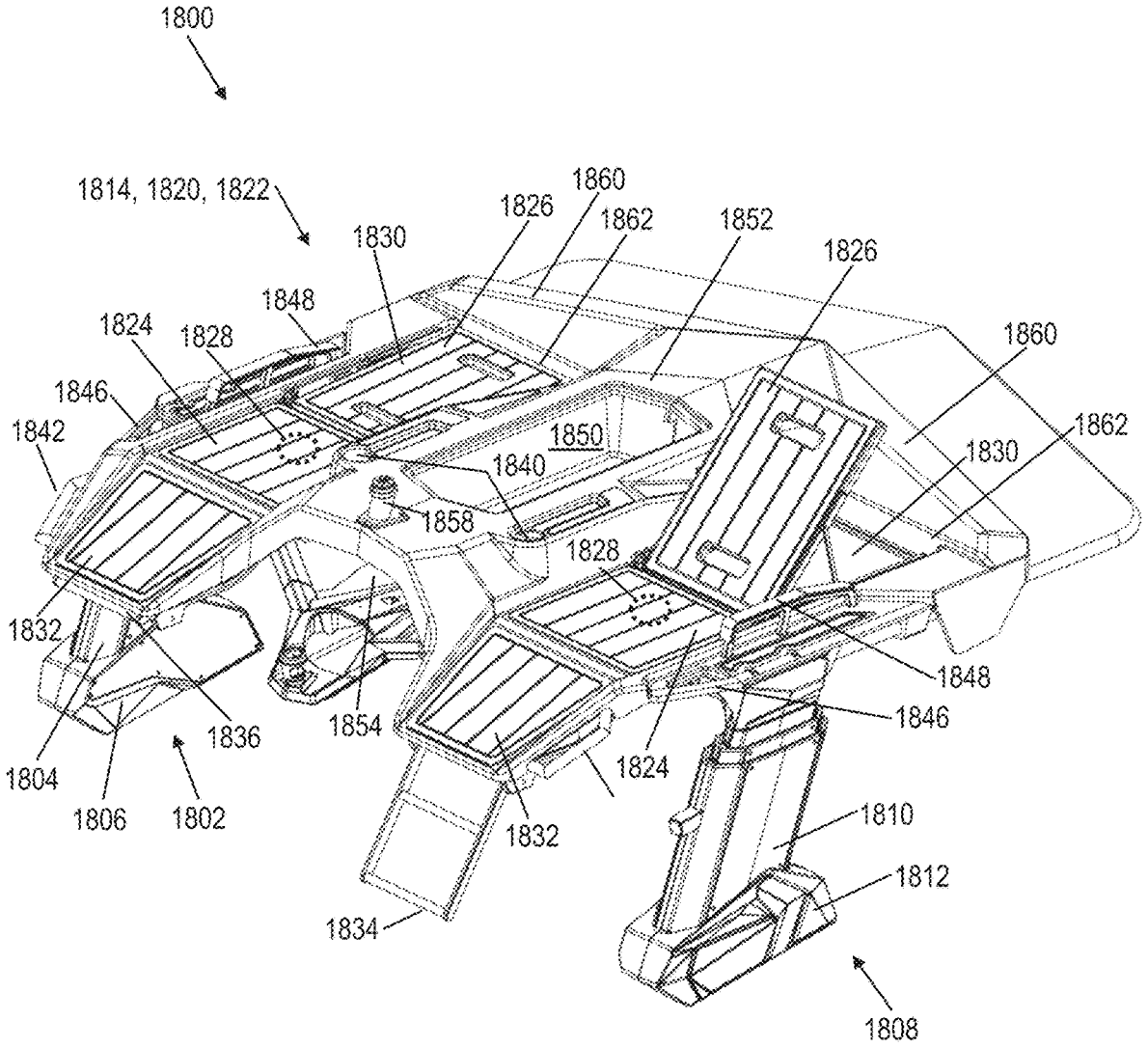
FIG. 18 is a perspective view of an example embodiment of the telescoping tower showing a center section with an integrated sun lounge platform with a seating arrangement.
Figure 19:
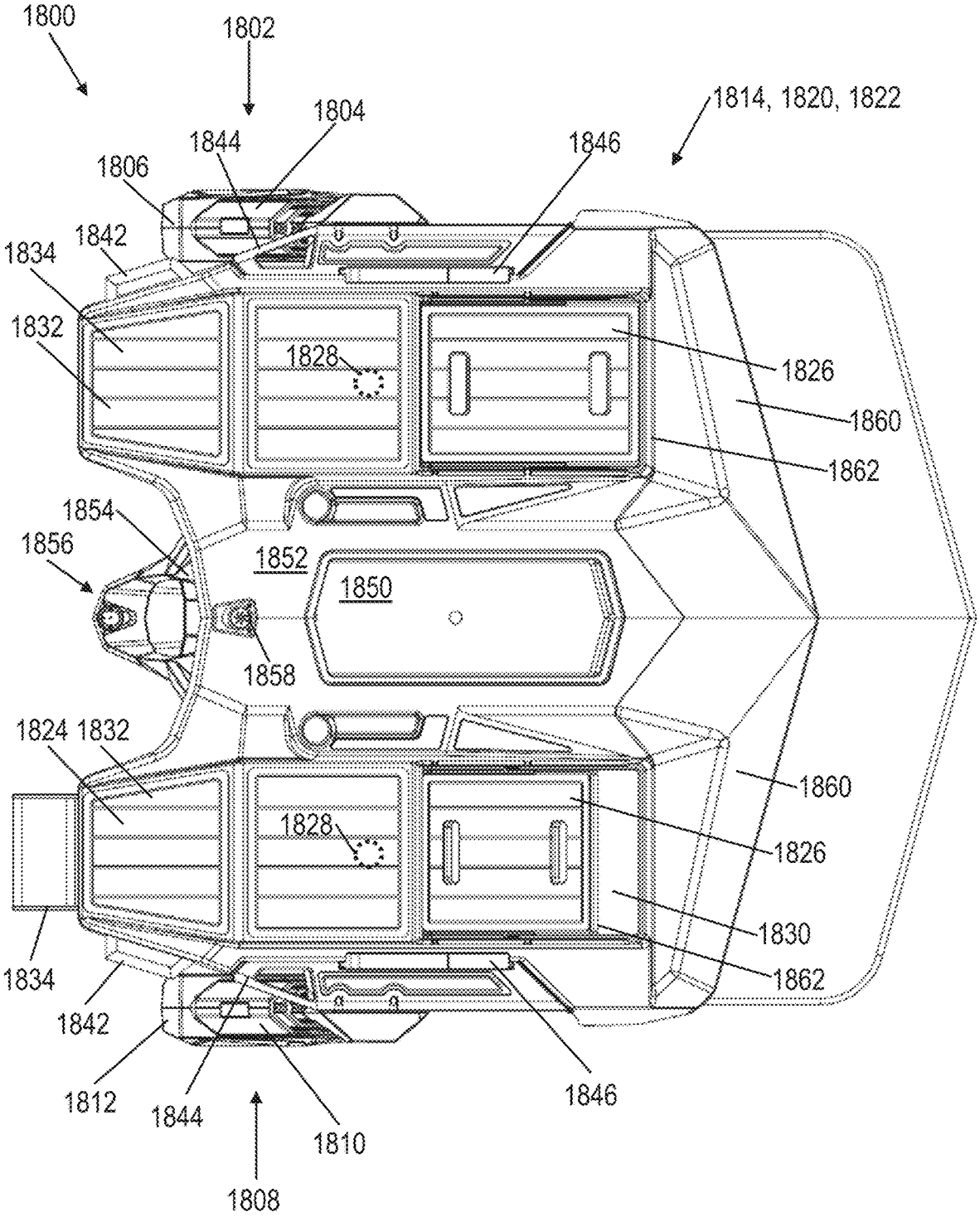
FIG. 19 is a top view of an example embodiment of the telescoping tower.
Figure 20:
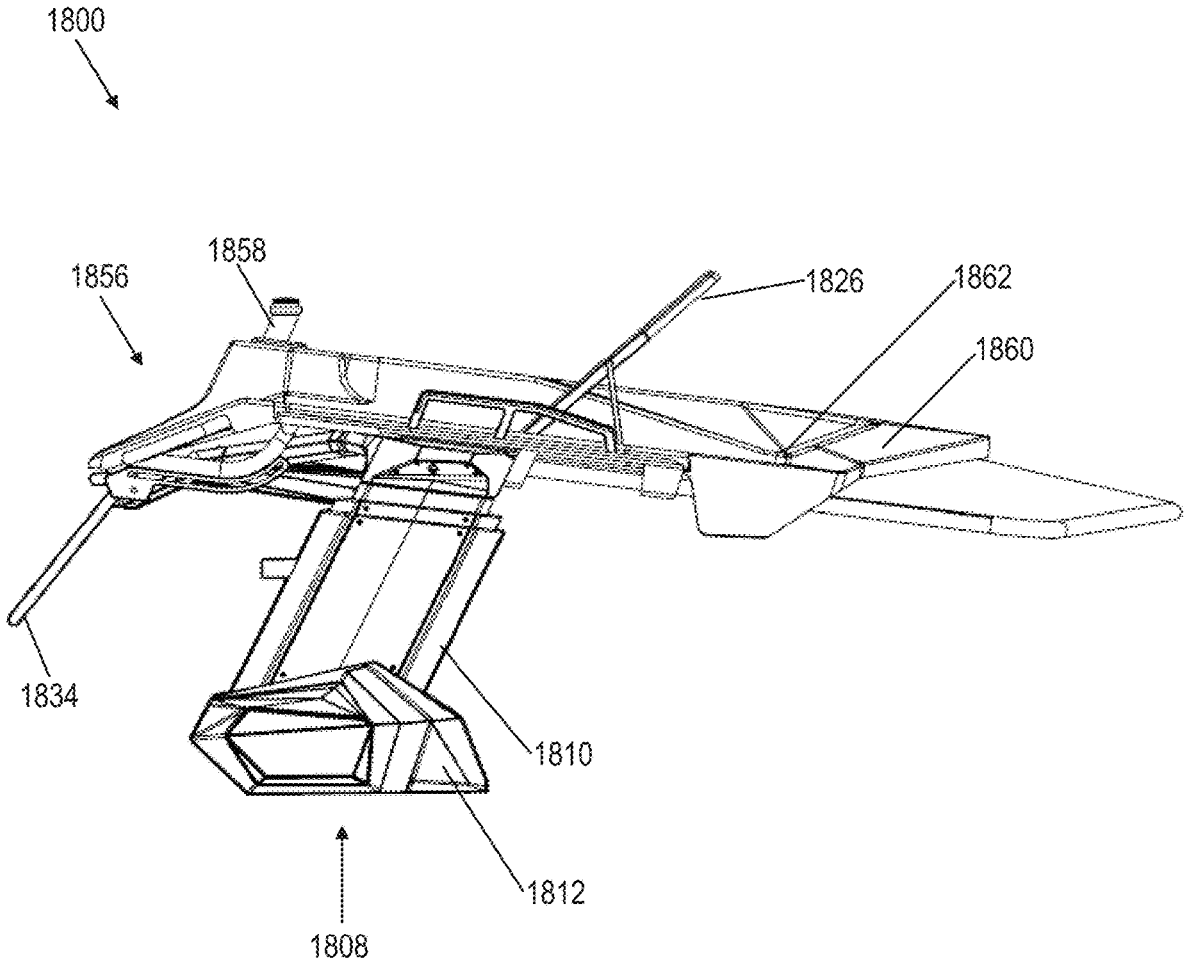
FIG. 20 is a side view of an example embodiment of the telescoping tower.
Figure 21:
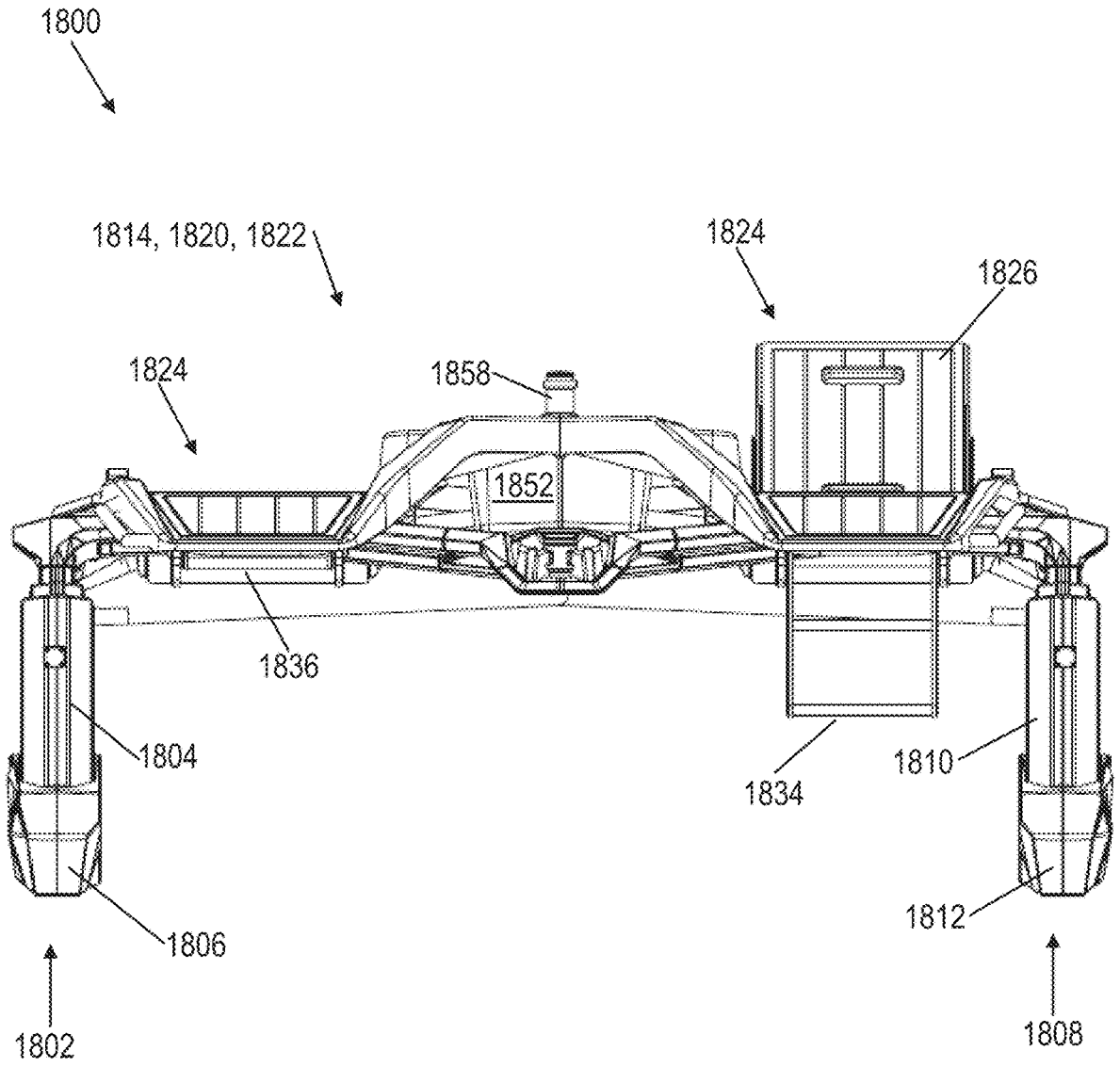
FIG. 21 is a rear view of an example embodiment of the telescoping tower.

Referring to FIGS. 1-17, there is shown various views of tower structure 100. Examples of tower structure 100 may include, but are not limited to, a tower that may be mounted to and used on various types of boats, general and specific in use, including wakeboard, surf, waterski, family, cruiser, run-abouts, fish boats, pontoon and other deck boats of the like. It will be appreciated that the tower structure 100 may be used on various sizes of boats including, but not limited to, power boats 17' to 50'. In some implementations, tower structure 100 may be used for towing an individual participating in watersports such as water skiing, wakeboarding, wake surfing, or other activities of the like. In some implementations, tower structure 100 may be used for elevating an individual on a boat to increase viewing capabilities for navigation, to avoid obstacles, and/or to view fish from a distance. In other implementations tower structure 100 may be used to mount navigational or communications equipment, fishing rods, speakers, lights or other types of equipment. In some implementations, tower structure 100 may also be used for aiding in equipment storage, aiding in a Bimini system, or any combination thereof. As also noted above, in some implementations, tower structure 100 may include and/or may be configured to be used in conjunction with a Bimini top (e.g., by providing partial and/or complete mounting points for a Bimini, and/or by including an integrated Bimini, etc.). Example embodiments of tower structure 100 that are configured to be used in conjunction with a Bimini and/or configured to include a Bimini may include various additional features and/or combinations of features that may include and/or partially support or mounts a Bimini and/or windshield cover system.

With continued reference to the example implementations of FIGS. 1-17, an example of tower structure 100 may include center section 104 of tower 102. Tower structure 100 may also include at least first support 106 and second support 108 each comprising telescoping assembly 110. Telescoping assembly 110 may include two or more members 112 longitudinally moveable relative to one another for moving center section 104 of tower 102 between at least first position 114 and second position 400. Tower structure 100 may also include actuator 700 for longitudinally moving two or more members 112 of at least first support 106 and second support 108 relative to one another to move center section 104 of tower 102 between at least first position 114 and second position 400.

As generally discussed above, tower structure 100 may include center section 104 of tower 102. As will be elaborated upon in greater detail below, center section 104 may be raised and lowered, for example, between a first, e.g., extended position that may be suitable for towing an individual participating in a watersport, and a second, e.g., retracted position, which may, for example, reduce the overall height of the boat. Reducing the overall height of the boat may, in some situations, facilitate storage and/or transportation of the boat (e.g., via trailering or the like), and/or reduce the air draft of the boat (e.g., to facilitate passing under low bridges or other overhead obstructions). As will be elaborated upon in greater detail below, tower 102 may include one or more attachments for watersports equipment (e.g., boards, skis, etc.). For example, tower 102 may be configured to integrate Bimini Tops, Platforms, Audio systems, and a storage apparatus.

In some implementations, tower structure 100 may include at least first support 106 and second support 108. The supports may each comprise telescoping assembly 110. For example, telescoping assembly 110 may include two or more members 112 longitudinally moveable relative to one another for moving center section 104 of tower 102 between at least first position 114 and second position 400. As will be elaborated upon in greater detail below, center section 104 may be supported above a deck of a boat by supports of tower 102, with at least one support generally located adjacent each of the two opposed sides of the boat. For example, an illustrative example embodiment of tower 102 consistent with the present disclosure is shown, in which FIGS. 1-17 may variously depict views of example tower 102 showing an example embodiment of a boat tower system with vertical extension and retraction of a main structural tower assembly including two or more members 112 that may be implemented to move center section 104 of tower 102 between at least first position 114 and second position 400. For instance, each of the two or more supports 106, 108, may include two or more individual members 112 that may move relative to one another, e.g., along a longitudinal dimension of the individual members 112 (and/or along another dimension of the members that may allow for the raising and lowering of the center section), to allow each of the supports to extend in a telescoping manner. It will be appreciated that each of the supports may include more than two members that may move relative to one another to provide the telescoping extension and retraction of tower 102. As will be elaborated upon in greater detail below, each of the supports may be mounted to a boat (e.g., to a deck of the boat). While the description herein may generally refer to two supports, it will be appreciated that a tower consistent with the present disclosure may utilized a greater number of supports. Further, while the supports have generally been depicted as being disposed on either side of the boat and/or on either side of the center section, other configurations are considered within the present disclosure. For example, a support may be generally centrally located relative to the boat and/or relative to the center section. Further, it will be appreciated that combinations of supports located adjacent either side of the boat and/or center section, and located inboard of one or both sides of the boat.

In some implementations, tower structure 100 may include actuator 700 for longitudinally moving two or more members 112 of at least one of the two or more supports 106 and 108 relative to one another to move center section 104 of tower 102 between at least first position 114 and second position 400. Consistent with the present disclosure, actuator 700 may include any suitable electrical, hydraulic, pneumatic, mechanical, and manual mechanisms and/or systems (and/or combinations of two or more different mechanisms) to move the members of each support relative to each other to achieve the telescoping extension of tower 102. Some illustrative examples of suitable actuators may include, but are not limited to, linear actuators, rack and pinion mechanisms, screw drive mechanisms, pulley and cable/rope mechanisms, pneumatic/hydraulic pistons, and the like. For example, the two or more supports 106, 108, may utilize actuators only fixed at one point and a secondary attachment may be floating and attached to a moving mechanical system. In some embodiments, the actuator may be configured to both extend and retract one or more of the supports. Further, in some embodiments, the actuator may be configured to extend one or more of the supports, and the supports may retract under the force of gravity acting on the tower. Consistent with some such embodiments, while the actuator may not necessarily actively retract the supports, the actuator may provide for the controlled retraction of the supports under the force of gravity. For example, and with particular reference to FIGS. 7-8, an illustrative example embodiment of power actuators consistent with some embodiments of the present disclosure are shown with an interior of supports 106, 108 exposed (e.g., through the removal/transparent rendering of covers or pieces of tower 102). In such an implementation, actuator 700 may be built into at least one of the two or more supports 106 and 108 of the port and/or starboard side of tower 102 for extending and retracting center section 104 of tower 102. Actuator 700 may be completely and/or at least partially disposed within the thickness of each respective support. Accordingly, actuator 700 may be at least partially housed within a respective support. In such an arrangement, actuator 700 may be protected against interference by foreign objects and/or the risk of injuring a user or bystander from inadvertent contact with actuator 700 (e.g., during operation of telescoping assembly 110). It will be appreciated that other configurations may also be utilized. For example, and as will be explained in further detail below, in some embodiments, actuator 700 may be partially, or fully, disposed within one, or more, of a respective base and/or disposed beneath one, or more, of the bases (e.g., below a deck of a boat, or disposed in another suitable location). Additionally, it should be understood that while each of the supports may include a respective actuator, in some embodiments, an actuator may be associated only with a one of the two or more supports, with the other supports telescoping in response to telescoping of the first support (e.g., by way of the center section, which may be connected between the supports).

In some implementations, at least first support 106 and second support 108 may be respectively positioned at opposing ends of center section 104 of tower 102. For example, center section 104 may be supported above a deck of a boat by at least a first support 106 and second support 108, with at least one support generally located adjacent each of the two opposed sides of the boat. It will be appreciated that in various embodiments, the center section may include a discrete component from the supports, and may be coupled to the supports (e.g., via any suitable mechanical fasteners and/or interaction), the center section may include at least a portion of one, or more, supports (e.g., at least one of the two or more individual members of each of the supports may form part of the center section), and/or the center section may otherwise be associated with the supports.

Consistent with some embodiments of the present disclosure, tower structure 100 may further include two or more bases (e.g., first base 118, and second base 120), each associated with a respective support 106, 108, for mounting the support to a boat. For example, each of the two or more supports 106, 108, of tower structure 100 may be mounted to a boat, e.g., to a deck of the boat and/or to other structural features of the boat, by respective base features. Additionally, each of the two or more supports 106, 108, may mount to the deck of the boat on both port and starboard attachment points (i.e., mounts and/or bases 118, 120). In some embodiments, the actuator for extending and retracting the supports may be at least partially disposed within one or more of the bases, and/or may be disposed within the boat. Consistent with such embodiments, the supports may be moved via pushrods, cables/ropes, and/or other suitable mechanical features extending from the actuator(s) at least partially disposed within the base(s) and/or boat.

In some implementations, the two or more supports 106, 108, may each be configured to extend and retract, via the two or more members 112, to raise and lower center section 104 of tower 102 between a at least a first height above a deck of the boat and a second height above the deck of the boat. As generally mentioned above, the supports may be extendable in a telescoping manner to raise and lower center section 104 of tower 102. By way of raising and lowering center section 104, center section 104 may move between at least a first height above the deck of the boat (e.g., an extended position) and a second height above the deck of the boat (e.g., a retracted position). Consistent with this configuration, the first height may be greater than the second height. In some implementations, the tower supports (i.e., support 106 and support 108) may recess and/or lower below the deck of the boat or into the deck of the boat, e.g., which may allow the overall height of the tower to be reduced when retracted. Additionally, while the supports have generally been discussed as including at least two individual members that are moveable relative to one another, in some embodiments, a greater number of members may be utilized, e.g., such that each individual member may be relatively shorter. Consistent with such an arrangement, it may be possible to achieve a lower height of the tower in the retracted position. As generally mentioned above, each support may be extendable in a telescoping manner to raise and lower center section 104 of tower 102. For example, supports 106, 108, may be extendable to position center section 104 at a plurality of heights between the first height and the second height. In such an implementation, the plurality of heights between the first height and the second height may include discrete incremental heights and/or continuously variable heights relative to the deck of the boat. Further, the tower assembly (i.e., two or more supports 106, 108, and center section 104) may lower and be completely above the deck of the boat in a retracted position.

In some implementations, at least two members of two or more members 112 of the respective supports may be arranged alongside one another. For example, the at least two members of two or more members 112 of each support 106, 108, may be generally arranged alongside one another (e.g., without being at least partially nested), and may be configured to move relative to one another to extend and retract. Consistent with such embodiments, the at least two members may be arranged alongside one another in a fore-aft configuration (e.g., with one member in an aft position relative to another member), in a side-to-side configuration (e.g., with one member in an inboard position relative to another member), in combinations of arrangements, and/or in other suitable configurations.

In some implementations, at least first member 1600 of two or more members 112 of the respective two or more supports, 106, 108, may be at least partially hollow such that it defines a channel. For example, and with particular reference to FIGS. 14-16, an illustrative example embodiment of at least first member 1600 of two or more members 112 of respective supports 106 and 108 consistent with the present disclosure is shown. A generally corresponding arrangement may be implemented in an embodiment in which at least first member 1600 of two or more members 112 of respective supports 106 and 108 may be at least partially hollow and/or define a channel extending in the longitudinal dimension of first member 1600. It will be appreciated that the channel may have a variety of cross-sectional shapes, including C-shaped, U-shaped, V-shaped, a compound and/or complex geometries (e.g., may have various indentations and/or protrusions), or the like. Further, in some embodiments the at least partially hollow member may have a closed geometry, such as rectangular, square, diamond, oval, polygonal, compound and/or complex closed geometry, or the like.

With continued reference to the illustrated embodiment, at least second member 1602 of two or more members 112 of the respective two or more supports 106 and 108 may be at least partially disposed within the channel of at least first member 1600. For example, at least second member 1602 of two or more members 112 may be at least partially disposed within the hollow or channel of first member 1600 (e.g., in an at least a partially nested arrangement) in at least some positions of tower 102 (e.g., when tower 102 is in retracted position) to provide a generally nested arrangement. It will be appreciated that the second member may have an external geometry that is at least partially complementary to the internal geometry of the at least partially hollow first member. Further, in some embodiments, the second member may have an external geometry that is different than the internal geometry of the at least partially hollow first member, but may be dimensioned to be at least partially received within the first member.

In some implementations, the two or more supports 106 and 108 may be positioned at an angle 900 toward the inside of the boat (e.g., toward a fore-aft centerline or plane of the boat). For example, and with particular reference to FIG. 9, an illustrative example embodiment of the degree at which supports 106, 108, of the telescoping tower may be angled consistent with the present disclosure is shown. For example, supports 106, 108, may be angled into the inside of the boat at an angle of, for example, but not limited to, 0 degrees to 30 degrees. It will be appreciated that various additional and/or alternative arrangements may be employed. By angling the supports at such an angle, the relationship between the supports and the overall tower structure may create a pyramid and/or arch effect, consequently adding strength to the overall tower structure 100. It will be appreciated that, in an embodiment in which the two or more supports may be angled toward the inside of the boat that the spacing between the tops of the supports may be greater in the retracted position than the spacing between the tops of the supports in the extended position. Accordingly, in some such embodiments provisions may be made to account for this change in spacing. For example, in some embodiments the width of the center section may be capable of increasing and decreasing to accommodate the change in spacing between the tops of the supports as they move between the extended and retracted positions. In a particular illustrative embodiment, the center section may be connected to one, or more, of the supports via a slide mechanism that may allow for the change in spacing between the tops of the supports. Examples of slide mechanisms may include, but are not limited to, cooperating rail features (e.g., captured rails such as dovetails; slide rails, with or without ball bearings or other friction reducing elements; cooperating captured geometries that allow relative linear movement, etc.), a slot in either the center section or the supports with a protrusion (such as bolt, a dowel or block, etc.) on the other of the center section and supports, linear slides, or the like. Further, in some embodiments, the supports may be pivotally mounted relative to the boat and may be capable of pivotal movement relative to the center section. In such an arrangement, the angle between the supports and the boat may increase as the supports are retracted to provide a generally constant spacing between the tops of the supports. In a further implementation, the center section may be configured to have a variable width, such that the center section may have a greater width (e.g., between connection points with the supports) when the supports are in a retracted position. For example, the center section may include one or more telescoping features, so that the width of the center section may be capable of increasing and decreasing a sufficient amount to accommodate the changes in spacing between the supports. In a further illustrative example embodiment, the center section may be hinged about a vertical axis, and may be coupled with the supports to provide pivotal movement about a vertical axis. For example, as shown in the top view of FIG. 3 a central portion of the center section may be positioned forward (or aft) of the lower portions of the supports. The central portion may include a hinge or pivot about a vertical axis. As the tower is moved to the retracted position the pivot may allow the center section to pivot apart and/or open up to provide a greater width of the center section. In some embodiments, the center section may also be pivotal relative to the supports, e.g., to accommodate the pivotal spreading of the center section. In some embodiments, the center section may include latches and/or cooperating features (e.g., tongue and groove features, overlapping features, etc.) that may rigidify and/or provide additional structural integrity for the center section when the supports are in the extended position (e.g., when the center section is pivoted together or closed). It will be appreciated that various additional and/or alternative configurations may be provided to accommodate a change in the spacing of the top portions of the supports between the extended and retracted positions. Additionally, while an angled arrangement of the supports toward the inside, or centerline, of the boat has been discussed, it will be appreciated that the supports may also be angled forward or aft relative to the boat, e.g., to provide "swept" orientation.

In some implementations, one or more of center section 104 and the two or more supports 106 and 108 may include a plurality of attachment points 300, 302, configured to attach to a Bimini system. For example, an illustrative example embodiment of a top view of the telescoping tower consistent with the present disclosure is shown, in which FIGS. 1-14, and 17, may depict views of the example tower with attachment points along various locations of tower structure 100. For example, attachment points 124, 126 may be integrated into the support sections 106, 108, of tower 102 and may be used to mount accessories. The two or more supports 106, 108 and/or between center section 104 and the supports 106, 108 of tower 102 may include attachment points 300, 302, equipped for attaching a sun shade (e.g., a Bimini system). Example Bimini systems may include hard and/or soft Biminis. For example, a hard Bimini may be generally self-supporting, while a soft Bimini may include a frame (e.g., a perimeter frame, cross-ribs, etc.) that may support the Bimini in an expanded manner to provide sun and/or weather protection for occupants of the boat.

With continued reference to the illustrated embodiment, tower structure 100 can include and/or attach to, and raise and lower, integrated Bimini Tops, Platforms, Audio systems, Sun Lounge, storage apparatus and/or compartments (e.g., for storing and/or mounting watersports equipment and accessories, fishing equipment and accessories, and/or other equipment). For example, the Bimini system may include a Bimini Top that may act in whole or in part as a boat cockpit cover system in at least first position 114, second position 400, and various positions in between of the tower structure 100.

In some further implementations, the Bimini Top may provide a sun lounge platform or seating/laying arrangement or functionality on top of tower structure 100. Consistent with such a configuration, the Bimini Top on the tower structure 100 may have lounge seating back rests that may fold up from the sun lounge platform. For example, the lounge seating back rests may provide one or more reclining positions and/or angles relative to the sun lounge platform. In a corresponding manner, the Bimini sun lounge platform may have a weight sensor switch built into the structure itself and/or otherwise capable of detecting the presence of an object above a threshold weight on the Bimini, which may be connected to a computer and/or control system on the boat. As such, the weight sensor may, for example, prevent and/or provide a warning to a driver of the boat in connection with the driver's attempt to change the position of center section 104 of tower 102 when an occupant is detected on the sun lounge platform.

FIG. 18 to FIG. 21 show an example embodiment of the tower structure 1800 described above. The tower structure 1800 includes the first support 1802 having the first telescoping assembly 1804 and the first base 1806, the second support 1808 having the second telescoping assembly 1810 and the second base 1812, and the center section 1814. The center section 1814 includes the sun lounge platform 1820 configured as a hard top for a boat with a single helm station and having the seating arrangement 1822. The seating arrangement 1822 includes two discrete lounge seats 1824. As shown, the lounge seats 1824 are configured to face a stern of the boat. Each lounge seat 1824 comprises the back rest 1826 that is configured to fold up and down from the sun lounge platform 1820 and to provide at least one reclining position. Each lounge seat 1824 optionally includes the sensor arrangement 1828 configured to detect the presence of the occupant in the seating arrangement 1822 and to provide the warning in response to a command to raise or lower the center section 1814 when the center section 1814 is occupied. The lounge seats 1824 are each disposed in a respective seat station 1830 recessed into the sun lounge platform 1820. In the example embodiment shown, the back rest 1826 folds up from and down into the seat station 1830. The lounge seats 1824 may include respective leg rests 1832.

The tower structure 1800 may include one or more ladders 1834 configured to extend from and retract into a storage position 1836 (FIG. 18) under the sun lounge platform 1820. The tower structure 1800 may include one or more handholds 1842, 1844, 1846 designed to aid access to the lounge seat 1824. Cup holders 1848 may be disposed in the sun lounge platform 1820 for access by occupants in the lounge seats 1824. The tower structure 1800 may include a storage compartment 1850 recessed into a top 1852 of the sun lounge platform 1820. The storage compartment 1850 may include a discrete opening 1854 through an aft end 1856 of the sun lounge platform 1820. In addition, the sun lounge platform 1820 may include a tow line attachment structure 1858 configured to tow an individual during watersports activities such as wake boarding etc. The sun lounge platform 1820 may also include a fairing 1860 disposed fore of the seat station 1830 and effective to direct wind over a leading edge 1862 of the seat station 1830 during forward movement of the boat.

In an example embodiment, the sun lounge platform 1820 includes a metal frame structure (e.g. extruded) with flat panel surfaces filling the gaps between the metal frame structure. In an alternate example embodiment, the sun lounge platform 1820 could be a molded part composed of, for example, fiberglass, carbon fiber, and/or plastic. This example embodiment of the tower structure 1800 may further include any and all features disclosed herein for any and all other example embodiments of the tower structures.

In some implementations, the two or more supports 106,108 may include a plurality of sections including one or more storage compartments. For example, tower structure 100 may provide one or more storage capabilities, e.g., for storing items related to watersports usage of tower structure 100, and/or unrelated to watersports usage of tower structure 100. Embodiments providing storage capabilities may include various features and/or combinations of features, including, but not limited to the tower supports (i.e., a plurality of sections of two or more supports 106, 108) or bases of the supports (i.e., two or more bases 118 and 120) including personalized storage compartments. For example, each of the two or more bases 118 and 120 (located, e.g., at starboard and port of tower structure 100) may include a personalized storage compartment. The personalized storage compartment may have an access door or removable cover to provide access to the storage area in the base. Consistent with the foregoing, the personal storage compartment may also have a locking mechanism built into the access door to keep personal effects safe. As such, it will be appreciated that the personalized storage compartments may be used to store personal effects within tower structure 100, such as sun glasses, phones, wallet, keys, and other items of the like. The personal storage compartment within the tower side sections may have one or more removable sub-storage bags or pouches to place the aforementioned personal effects or other items inside. It will also be appreciated that the personal storage compartment may or may not have lighting integrated within the compartment itself. The personal storage compartment may also include a plurality of connections and/or features for providing wired and/or wireless charging of mobile devices, computers, and/or any device of the like.

Figure 22:
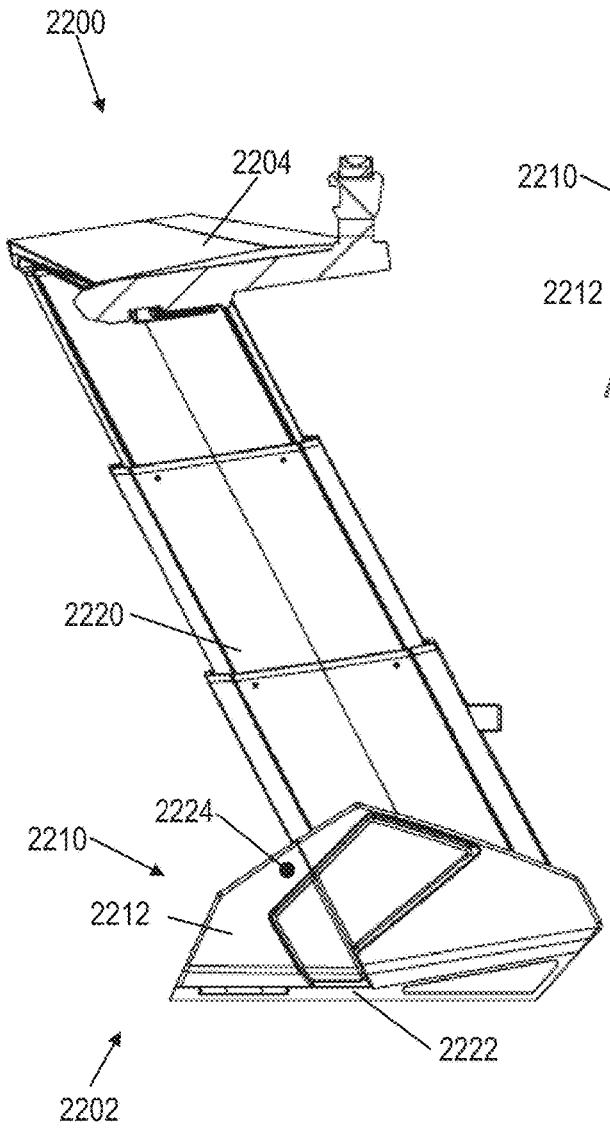
FIG. 22 is a side cross sectional view of an example embodiment of the telescoping tower showing a storage compartment in a closed configuration.
Figure 23:
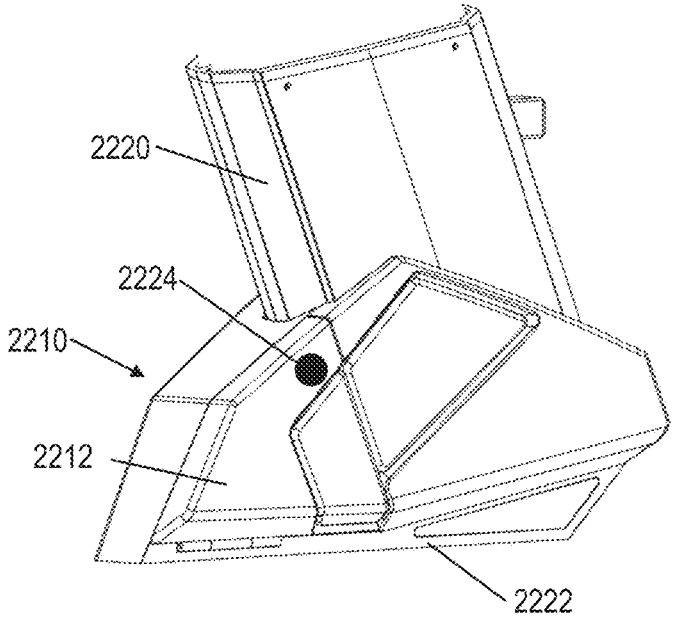
FIG. 23 is a closeup of the side cross sectional view of FIG. 22.
Figure 24:
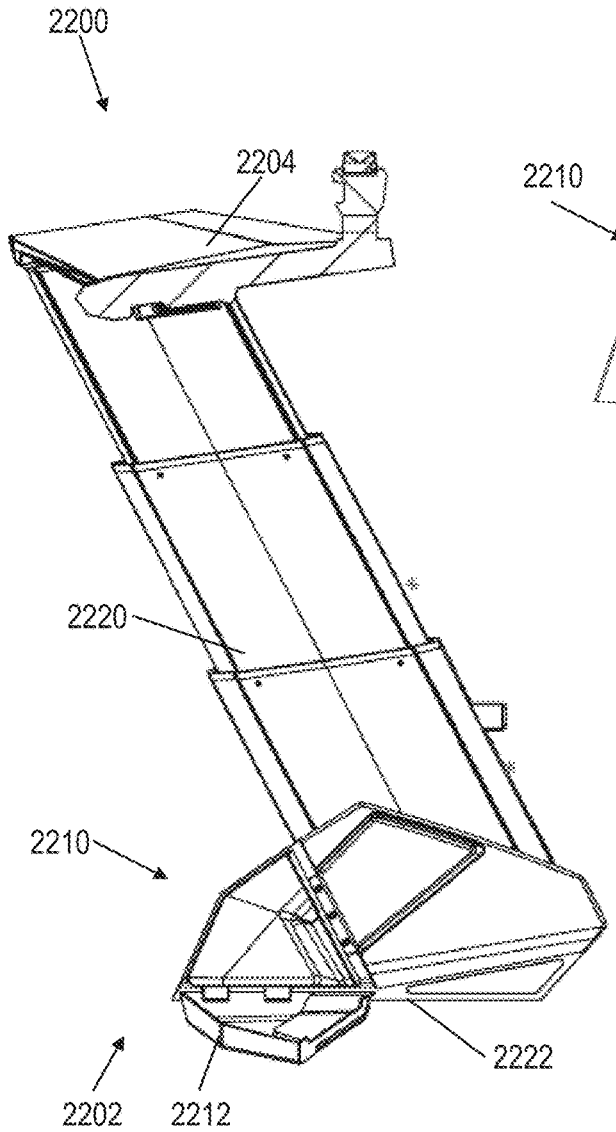
FIG. 24 is a side cross sectional view of an example embodiment of the telescoping tower showing a storage compartment in an open configuration.
Figure 25:
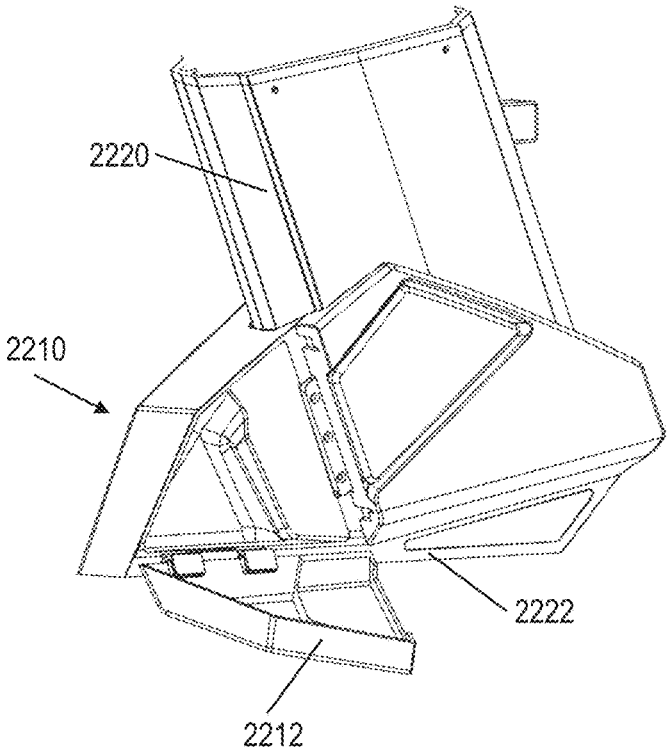
FIG. 25 is a closeup of the side cross sectional view of FIG. 24.
Figure 26:
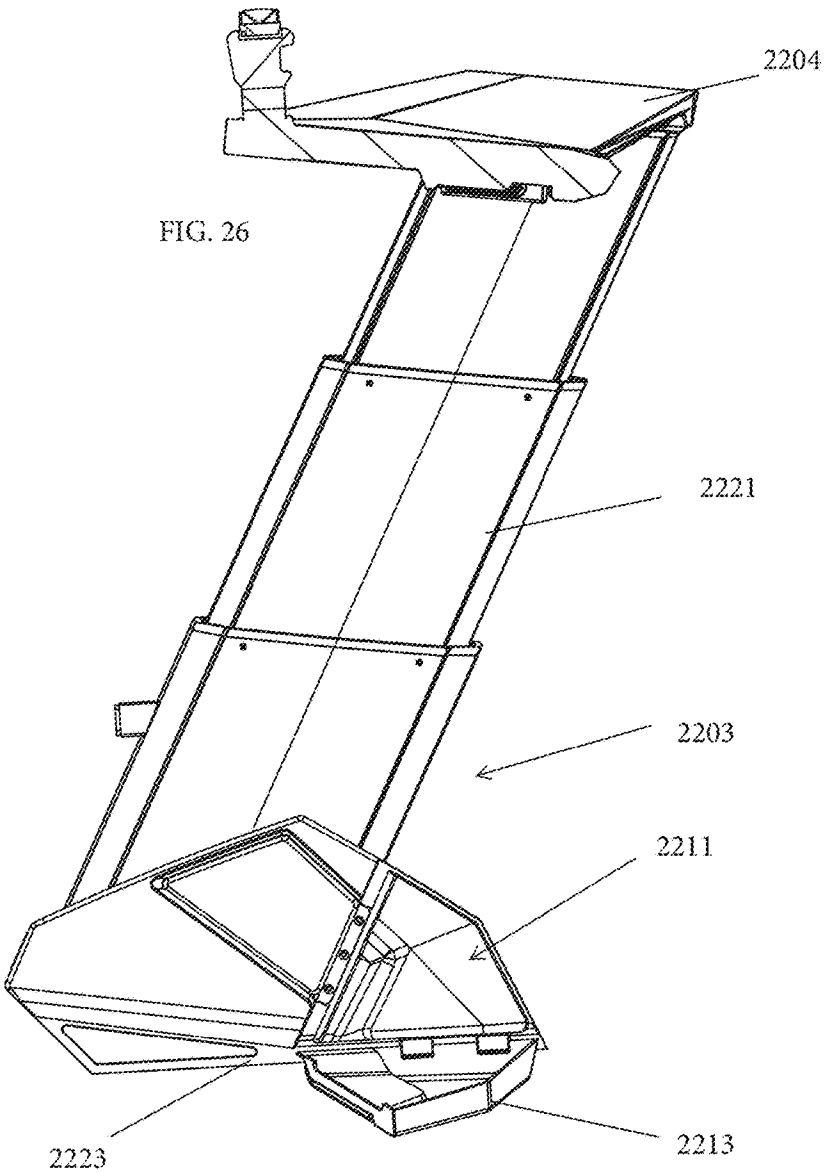
FIG. 26 is a side cross sectional view of an example embodiment of the telescoping tower showing a storage compartment in an open configuration.
Figure 27:
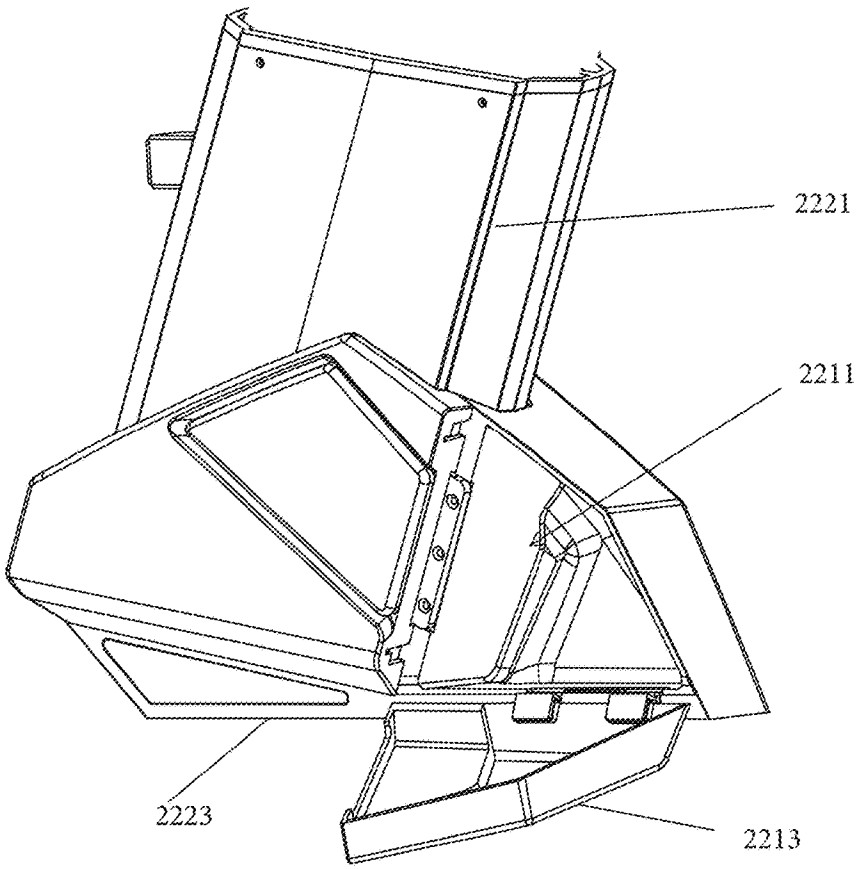
FIG. 27 is a closeup of the side cross sectional view of FIG. 26.

FIG. 22 and FIG. 23 show a side cross section of an example embodiment of a tower structure 2200 with a support 2202 for the center section 2204. The support 2202 has a storage compartment 2210 having a cover 2212 in a closed configuration. The view in FIG. 22 and FIG. 23 is that of a passenger in the boat, which means that the storage compartment 2210 is disposed on an inside side of the support 2202. As shown, the support 2202 includes a base 2222 and may be static or optionally include a telescoping assembly 2220. An optional lock 2224 secures the cover 2212 in place and thereby locks the storage compartment 2210. FIG. 24 and FIG. 25 show the support 2202 with storage compartment 2210 in an open configuration. FIG. 26 and FIG. 27 shows a support 2203 for the center section 2204 with a storage compart 2211 having a cover 2213 in an open configuration. The support 2203 includes a base 223 and may be static or optionally include a telescoping assembly 2221. Support 2202 and support 2203 are configured for securement to opposite sides of a boat. Similar to that discussed above, storage compartment 2211 may also have an optional lock (not shown). This example embodiment of the tower structure 2200 may further include any and all features disclosed herein for any and all other example embodiments of the tower structures.

As generally discussed above, tower 102 may be positioned in an extended configuration in first position 114. For example, an illustrative example embodiment of tower structure 100 consistent with the present disclosure is shown, in which FIGS. 1-3, 7, 9-14, and 17 may variously depict views of the example tower in an extended configuration. As shown at least in FIG. 13, one or more horizontal wedge shapes 1300 of the two or more members 112 may engage when in full upright (i.e., extended) position, thereby adding structural support to the main body of the tower structure 100. For example, sections of tower structure 100 may include a lock system to latch tower 102 in an upright (i.e., extended) position.

In some implementations, tower 102 may be positioned in a retracted configuration in second position 400. For example, an illustrative example embodiment of tower structure 100 consistent with the present disclosure is shown, in which FIGS. 4-6, and 8, may variously depict views of the example tower in a retracted configuration. As previously described above, the two or more supports 106 and 108 may be extendable in a telescoping manner to raise and lower center section 104 of tower 102. In some implementations, the tower supports (i.e., first support 106 and second support 108) may recess and lower below the deck of the boat or into the deck of the boat, e.g., which may allow the overall height of the tower to be reduced when retracted. Further, the tower assembly (i.e., supports 106, 108, and center section 104) may lower and be completely above the deck of the boat in a retracted configuration.

In some implementations, tower structure 100 may include center section 104 of tower 102. Tower 102 may be used for various tow watersports when in the first (i.e., extended) position 114 and second position 400. The second (i.e., retracted) position 400 of tower 102 may also solve the need for lowering tower 102 for storage, travel, and cover of the vessel. Tower 102 may lower and be completely above the deck of the boat in the lowered position. Consistent with the present disclosure, center section 104 may include one or more tow heads 116 to which a tow rope may be attached and used by an individual participating in a watersport, and/or other features general and specific in use.

In some implementations, tower structure 100 may include at least first support 106 and second support 108. Each support may comprise telescoping assembly 110. For example, telescoping assembly 110 may include two or more members 112 longitudinally moveable relative to one another for moving center section 104 of tower 102 between at least first position 114 and second position 400. Each support may be configured to extend and retract, via two or more members 112, to raise and lower center section 104 of tower 102 between at least a first height above a deck of the boat and a second height above the deck of the boat. Consistent with some embodiments, at least a portion of tower 102 may be raised and lowered, for example, between a raised (i.e., extended) position that may be suitable for towing an individual participating in a watersport, and a lowered position (i.e., retracted), which may reduce the overall height of the boat, e.g., to facilitate storage and/or transportation of the boat (e.g., via trailering or the like), and/or to reduce the air draft of the boat (e.g., to facilitate passing under low bridges or other overhead obstructions). The tower top overall width may be wider in the retracted, lowered position than in the extended, raised position. Additionally, and with particular reference to FIG. 14, an illustrative example embodiment of a telescoping tower consistent with the present disclosure is shown. In such an implementation, the two or more supports 106 and 108 may be extendable in a telescoping manner to raise and lower center section 104 of tower 102. For example, supports 106, 108, of tower 102 may extend and retract on a system of one or more parallel rails 1400 per support to guide and buffer components of tower 102. By way of this telescopic function, raising and lowering of center section 104 may solve the need for lowering tower 102 for storage, travel, and cover of the vessel (i.e., boat).

In addition to the described arrangement for extending and retracting tower 102, various mechanisms and/or arrangements may be included for securing tower 102 in the extended and/or in the retracted configurations. For example, when tower 102 is in the retracted configuration, the nested portions of tower 102 may be secured to reduce and/or prevent bouncing (e.g., between an extended or raised position and then back to a more retracted or lowered position), for example due to movement of the boat, either while traveling on the water or during transport (e.g., via trailer). Similarly, in some embodiments, various locking mechanisms may be utilized to secure tower 102 in the extended position. Such locking mechanisms may reduce the likelihood of tower 102 partially and/or fully nesting as a result of a failure of actuator 700, or inadvertent actuation of the telescoping mechanism (e.g., by accidental actuation of a switch controlling the telescoping members of tower 100).

In some implementations, tower structure 100 may include actuator 700 for longitudinally moving two or more members 112 of at least one of the two or more supports 106 and 108 relative to one another to move center section 104 of tower 102 between at least first position 114 and second position 400. For example, and with particular reference to FIGS. 11-12, an illustrative example embodiment of telescoping tower consistent with the present disclosure is shown with an interior of the supports 106, 108, covered and exposed (e.g., through the removal/transparent rendering of side covers or pieces of tower 102). In such implementations, removable (or openable) access plates 1100 may be mounted to the telescopic support sections 106, 108, for access to actuator 700, service and assembly. Continuing with the foregoing, tower 102 may include a switch built into tower 102 to operate actuator 700 that will activate the raising and lowering of center section 104 of tower 102. The controls for raising and lowering tower 102 may be positioned on one or more boat control panels (e.g., helm console, or other control panels) or accessible areas for actuating tower 102 for raising or lowering the center section 104 of the tower structure 100. The controls may be built into a computer display/chart plotter or other instrument on the boat and activated by the driver from a helm area of the vessel. It will be appreciated that various interlocks and/or safeties may be included to prevent/reduce the likelihood of accidental or unsafe actuation of the folding mechanism. In some implementations, at least first support 106 and second support 108 are respectively positioned at opposing ends of center section 104 of tower 102.

It will be appreciated that, while the description herein references a center section and two or more supports, such designations are intended to identify the general location and nature of aspects of tower structure 100. For instance, in some embodiments, tower 102 may include an arch or a continuous structure, which may not include a discretely delineated "center section" and "side supports." Rather, supports 106, 108, and center section 104 may include a single and/or integral structure. Such embodiments are also contemplated by the present disclosure.

In some implementations, tower structure 100 may further comprise two or more bases 118 and 120 associated with a respective one of the two or more supports 106 and 108 for mounting each support to a boat. While in the illustrated example embodiment the two or more supports 106, 108, of tower structure 100 are depicted as being mounted via respective base features 118, 120, laterally spaced toward either side of the boat, it will be appreciated that the two or more supports 106, 108, may be coupled via other mounts to the boat, including, but not limited to, being directly mounted to the deck of the boat, to a support structure underlying the deck of the boat, to a gunwale feature of the boat, and/or to other suitable features of the boat and/or mounts associated with the boat.

In some implementations, at least two members of two or more members 112 of the respective supports may be arranged alongside one another. In some implementations, at least first member 1600 of two or more members 112 of the respective supports may be at least partially hollow such that it defines a channel. With continued reference to the illustrated embodiment, at least second member 1602 of two or more members 112 of the respective supports may be at least partially disposed within the channel of at least first member 1600. For example, and with particular reference again to FIGS. 14-16, sections of the two or more supports 106, 108, of tower 102 may nest into one another when retracting (i.e., lowering). For instance, sections of supports 106, 108 may slide up and down using a male and female slide system 1500 and/or cooperating features and/or geometries. In some implementations, the supports may be positioned at an angle 900 toward the inside of the boat.

In some implementations, tower structure 100 may include center section 104 of tower 102. Tower 102 may include interior lighting facing downward into the cockpit of the vessel (e.g., boat), and/or to the front, sides or rear of the vessel. Tower 102 may also include integrated navigation lights for the boat, such as an all-round navigation light 122. In some implementations, tower 102 may include a wire management system that allows wires needed for all-round navigation light 122 and other accessories to be raised and lowered without getting caught, damaged, or presenting a danger to occupants of the vessel.

As generally mentioned above, in some implementations, tower structure 100 may include at least first support 106 and second support 108. Each support may comprise telescoping assembly 110. For example, telescoping assembly 110 may include two or more members 112 longitudinally moveable relative to one another for moving center section 104 of tower 102 between at least first position 114 and second position 400. At least two members of two or more members 112 of the respective supports are arranged alongside one another, wherein the supports are each configured to extend and retract, via two or more members 112, to raise and lower center section 104 of tower 102 between at least a first height above a deck of the boat and a second height above the deck of the boat. An illustrative example embodiment of a front view of the telescoping tower consistent with the present disclosure is shown, in which FIG. 10, may depict views of the example tower with one or more mounting points along various locations of tower structure 100. For example, the two or more supports 106 and 108 and center section 104 may include one or more mounting points 1000 for navigational and communications equipment, fishing rods, and audio (speaker) cans of a custom shape, however, in some implementations, center section 104 of tower 102 may have integrated speakers. The overall tower structure 100 (including, but not limited to, center section 104 and/or two or more supports 106, 108, or mounting features (i.e., at least first base 118 and second base 120) for center section 104 and/or between center section 104 and the supports 106, 108) may be split and moved toward connection points of center section 104 and the supports 106, 108, thereby allowing tower structure 100 to change in overall width as center section 104 raises and lowers respective to the deck of the boat.

In some implementations, tower structure 100 may include actuator 700 for longitudinally moving two or more members 112 of at least one of the two or more supports 106 and 108 relative to one another to move center section 104 of tower 102 between at least first position 114 and second position 400. While the illustrated embodiment may depict actuator 700 configured for longitudinally extending and retracting, it will be appreciated that various additional and/or alternative mechanisms may be utilized that may release tower 102 for vertical extension and retraction of the main structural tower assembly, particularly under its own weight and in a controlled fashion. In some implementations, at least first member 1600 of two or more members 112 of each respective support is at least partially hollow such that it defines a channel. With continued reference to the illustrated embodiment, at least second member 1602 of two or more members 112 of each respective support may be at least partially disposed within the channel of at least first member 1600.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising," when used in this specification, specify the presence of stated features, integers, steps (not necessarily in a particular order), operations, elements, and/or components, but do not preclude the presence or addition of one or more other features, integers, steps (not necessarily in a particular order), operations, elements, components, and/or groups thereof.

The corresponding structures, materials, acts, and equivalents (e.g., of all means or step plus function elements) that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

A number of implementations have been described. Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. A telescoping boat tower, comprising:

a center section;

a first support secured to a first end of the center section, the first support comprising a first telescoping assembly; and a second support secured to a second end of the center section, the second support comprising a second telescoping assembly;

wherein the first telescoping assembly and the second telescoping assembly cooperate to raise and lower the center section between a first position and a second position; and wherein the center section comprises a sun lounge platform configured as a cockpit cover for a boat, the sun lounge platform comprising a seating arrangement.

2. The telescoping boat tower of claim 1, wherein the seating arrangement comprises a lounge seat configured to provide at least one reclining position.

3. The telescoping boat tower of claim 2, wherein the lounge seat comprises a back rest, and wherein the back rest is configured to fold up and down from the sun lounge platform.

4. The telescoping boat tower of claim 1, wherein the sun lounge platform further comprises a sensor arrangement configured to detect a presence of an occupant in the seating arrangement and to provide a warning in response to a command to raise or lower the center section when the center section is occupied.

5. The telescoping boat tower of claim 1, wherein at least one of the first telescoping assembly and the second telescoping assembly comprises two or more members, and wherein at least one member of the two or more members is at least partially hollow.

6. A boat, comprising the telescoping boat tower of claim 1.

7. A telescoping boat tower, comprising:

a sun lounge platform that is configured as a hard top for a boat with a single helm station and comprising a seat station recessed into the sun lounge platform;

a seat disposed in the seat station;

a first support configured to support a first end of the sun lounge platform; and a second support configured to support a second end of the sun lounge platform.

8. The telescoping boat tower of claim 7, wherein the sun lounge platform further comprises a discrete second seat station recessed into the sun lounge platform, and a discrete second seat disposed in the seat station.

9. The telescoping boat tower of claim 7, wherein the seat comprises a lounge seat configured to provide at least one reclining position.

10. The telescoping boat tower of claim 9, wherein the lounge seat comprises a back rest, and wherein the back rest is configured to fold up from and down into the seat station.

11. The telescoping boat tower of claim 10, wherein the lounge seat further comprises a leg rest.

12. The telescoping boat tower of claim 9, wherein the lounge seat is configured to face a stern of the boat comprising the helm station.

13. The telescoping boat tower of claim 9, further comprising a ladder secured to the sun lounge platform and leading to the seat.

14. The telescoping boat tower of claim 13, wherein the ladder is configured to extend from and retract into a storage position under the sun lounge platform.

15. The telescoping boat tower of claim 9, wherein the sun lounge platform further comprises a storage compartment disposed adjacent the seat and recessed into a top of the sun lounge platform.

16. The telescoping boat tower of claim 15, wherein the storage compartment further comprises a discrete opening through an aft end of the sun lounge platform.

17. The telescoping boat tower of claim 9, further comprising a fairing disposed fore of the seat station and effective to direct wind over a leading edge of the seat station during forward movement of the boat comprising the helm station.

18. The telescoping boat tower of claim 9, further comprising a handhold disposed adjacent the seat and integrated into the sun lounge platform.

19. The telescoping boat tower of claim 9, further comprising a cup holder disposed adjacent the seat and integrated into the sun lounge platform.

20. The telescoping boat tower of claim 9, the sun lounge platform further comprising a tow line attachment structure.

21. The telescoping boat tower of claim 9, wherein the first support comprises a first telescoping assembly, the second support comprises a second telescoping assembly, and the first telescoping assembly and the second telescoping assembly cooperate to raise and lower the sun lounge platform between a first position and a second position.

* * * * *